US008257511B2

(12) United States Patent
Nagata et al.

(10) Patent No.: US 8,257,511 B2
(45) Date of Patent: Sep. 4, 2012

(54) PERMANENT MAGNET AND A MANUFACTURING METHOD THEREOF

(75) Inventors: Hiroshi Nagata, Ibaraki (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 548 days.

(21) Appl. No.: 12/438,057

(22) PCT Filed: Aug. 22, 2007

(86) PCT No.: PCT/JP2007/066272

§ 371 (c)(1),
(2), (4) Date: May 20, 2009

(87) PCT Pub. No.: WO2008/023731

PCT Pub. Date: Feb. 28, 2008

(65) Prior Publication Data

US 2010/0164663 A1 Jul. 1, 2010

(30) Foreign Application Priority Data

| | | |
|---|---|---|
| Aug. 23, 2006 | (JP) | 2006-227122 |
| Aug. 23, 2006 | (JP) | 2006-227123 |
| Sep. 11, 2006 | (JP) | 2006-245302 |
| Sep. 12, 2006 | (JP) | 2006-246248 |

(51) Int. Cl.
*H01F 1/057* (2006.01)
*H01F 1/00* (2006.01)

(52) U.S. Cl. ..... 148/302; 148/101; 148/301

(58) Field of Classification Search ..... 148/101, 148/301, 302

See application file for complete search history.

(56) References Cited

U.S. PATENT DOCUMENTS

2007/0034299 A1 2/2007 Machida et al.

FOREIGN PATENT DOCUMENTS

| | | | |
|---|---|---|---|
| EP | 0395625 | A2 | 10/1990 |
| HU | 219793 | B | 2/1992 |
| JP | 2001135538 | | 5/2001 |
| JP | 2004296973 | | 10/2004 |
| JP | 2004304038 | | 10/2004 |
| JP | 2005-11973 | A | 1/2005 |
| JP | 2005011973 | | 1/2005 |
| JP | 2005-175138 | A | 6/2005 |
| WO | 2007102391 | | 9/2007 |

OTHER PUBLICATIONS

International Search Report for PCT/JP2007/066272 (Nov. 27, 2007).

*Primary Examiner* — Lois Zheng

(74) *Attorney, Agent, or Firm* — Cermak Nakajima LLP; Tomoko Nakajima

(57) ABSTRACT

One object of the present invention is to provide a method for manufacturing a permanent magnet which can effectively improving the magnetizing properties and coercive force with efficiently diffusing Dy into grain boundary phases without deteriorating a surface of sintered magnet of Nd—Fe—B family and does not require any subsequent working process. Sintered magnet S of Nd—Fe—B family and Dy are arranged in a processing chamber 20 apart from each other. Then Dy is evaporated by heating the processing chamber 20 under a reduced pressure condition to evaporate Dy with elevating the temperature of sintered magnet S to a predetermined temperature and to supply and deposit evaporated Dy atoms onto the surface of sintered magnet S. During which the supplying amount of Dy atoms onto the sintered magnet S is controlled so as to diffuse and homogeneously penetrate them into the grain boundary phases of sintered magnet before Dy layer is formed on the surface of sintered magnet.

15 Claims, 17 Drawing Sheets

[Fig. 6]

| | Before process | After process (975℃) |
|---|---|---|
| Br (kG) | 14.5 | 14.3 |
| iHc (kOe) | 11.3 | 23.1 |
| (BH)max (MGOe) | 50.5 | 49.9 |
| Weight increase ratio (%) | — | 0.45 |
| (BH)max+iHc | 61.8 | 73 |

[Fig. 7]

| | Dy configura-tion | Dy surface area/sintered magnet surface area | Br (kG) | iHc (kOe) | (BH)max (MGOe) | (BH)max+iHc |
|---|---|---|---|---|---|---|
| Non-film | — | (non-treated) | 14.6 | 10.5 | 51.8 | 62.3 |
| | Bulky (1mm φ) | 5.3E-05 | 14.6 | 11.8 | 51.6 | 63.4 |
| | Bulky (1mm φ) | 7.0E-05 | 14.6 | 14.5 | 52.4 | 66.9 |
| | Bulky (1mm φ) | 1.1E-04 | 14.6 | 19.8 | 51.6 | 71.5 |
| | Bulky (1mm φ) | 5.7E-04 | 14.6 | 19.8 | 51.6 | 71.5 |
| | Bulky (2mm φ) | 2.1E-03 | 14.6 | 21.6 | 52.1 | 73.7 |
| | Bulky (2mm φ) | 6.5E-03 | 14.6 | 22.1 | 52.0 | 74.1 |
| | Bulky (5mm φ) | 1.2E-02 | 14.6 | 23.9 | 51.5 | 75.4 |
| | Bulky (5mm φ) | 6.4E-02 | 14.6 | 23.6 | 52.0 | 75.7 |
| | Bulky (5mm φ) | 1.8E-01 | 14.6 | 23.7 | 52.0 | 75.6 |
| | Bulky (3mm φ) | 7.0E-01 | 14.6 | 23.7 | 51.8 | 75.6 |
| | Bulky (1mm φ) | 1.4E+00 | 14.6 | 23.8 | 52.1 | 75.9 |
| | Granular (0.4 mm) | 6.7E+00 | 14.6 | 23.7 | 51.9 | 75.6 |
| | Granular (0.4 mm) | 1.1E+01 | 14.6 | 23.5 | 52.2 | 75.7 |
| | Granular (0.4 mm) | 6.8E+01 | 14.5 | 22.7 | 51.4 | 74.1 |
| | Granular (0.01 mm) | 1.6E+02 | 14.5 | 21.4 | 51.4 | 72.8 |
| | Granular (0.01 mm) | 5.6E+02 | 14.5 | 20.9 | 51.7 | 72.6 |
| | Granular (0.01 mm) | 1.6E+03 | 14.4 | 19.6 | 51.0 | 70.5 |

| | | | | | | |
|---|---|---|---|---|---|---|
| Film | Granular (0.01 mm) | 4.8E+03 | 13.8 | 15.4 | 46.9 | 62.3 |
| | Granular (0.01 mm) | 6.0E+03 | 13.7 | 14.5 | 45.1 | 59.6 |

[Fig. 8]

| | Average grain diameter of sintered magnet (μ m) | | | | | |
|---|---|---|---|---|---|---|
| | 0.5 | 1 | 2 | 3 | 4 | 5 |
| Br (kG) | 14.1 | 14.3 | 14.4 | 14.8 | 14.7 | 14.4 |
| (BH)max (MGOe) | 47 | 50 | 52 | 54 | 53 | 51 |
| iHc (kOe) | 40 | 36 | 34 | 32 | 31 | 30 |
| Optimum vacuum vapor processing hour (hr) | 72 | 24 | 18 | 12 | 10 | 8 |
| | Comparative Example | Present Invention | | | | |

[Fig. 8 (continued)]

| Average grain diameter of sintered magnet (μ m) | | | | | | | | |
|---|---|---|---|---|---|---|---|---|
| 6 | 7 | 8 | 9 | 10 | 12 | 15 | 20 | 25 |
| 14.2 | 14.4 | 14.8 | 14.9 | 15 | 15.2 | 15.2 | 15.2 | 13.8 |
| 48 | 51 | 53 | 54 | 55 | 58 | 58 | 58 | 46 |
| 27 | 30 | 32 | 34 | 34 | 32 | 32 | 30 | 25 |
| 6 | 5 | 2 | 1 | 1 | 1 | 1 | 1 | 1 |
| Comparative Example | Present Invention | | | | | | | Comparative Example |

[Fig. 9]

| | Vacuum vapor processing | Component of magnet | Optimum vapor processing time | Br (kG) | (BH)max (MGOe) | iHc (kOe) | Evaluation of corrosion resistance |
|---|---|---|---|---|---|---|---|
| Embodiment 4 | Not-performed | 27Nd-1B-0.05Cu-0.05Ga-0.1Zr-bal. Fe | — | 14.4 | 51.2 | 11.4 | 6 hr or less |
| | Performed | | 2 | 15.5 | 59 | 18 | 120 hr or more |
| Comparative Example 4a | Not-performed | 27Nd-1Co-1B-0.05Cu-0.05Ga-0.1Zr-bal. Fe | — | 14.3 | 51 | 11.3 | 24 hr or less |
| | Performed | | 10 | 15.3 | 58 | 17 | 120 hr or more |
| Comparative Example 4b | Not-performed | 27Nd-4Co-1B-0.05Cu-0.05Ga-0.1Zr-bal.Fe | — | 14.4 | 52 | 11.1 | 48 hr or more |
| | Performed | | 22 | 15.2 | 56 | 16.5 | 120 hr or more |
| Comparative Example 4c | Not-performed | 27Nd-8Co-1B-0.05Cu-0.05Ga-0.1Zr-bal. Fe | — | 14.4 | 52 | 11 | 72 hr or more |
| | Performed | | 32 | 15.1 | 55 | 16.4 | 120 hr or more |

[Fig. 10]

| | | Temperature of vapor processing (℃) | | | | | | | |
|---|---|---|---|---|---|---|---|---|---|
| | Not-vapor proces-sing | 750 | 800 | 850 | 900 | 950 | 1000 | 1050 | 1100 |
| Br (kG) | 14.2 | 14.3 | 14.6 | 14.7 | 14.8 | 14.9 | 14.7 | 14.6 | 14 |
| (BH)max (MGOe) | 49 | 49.5 | 50 | 52 | 54 | 54 | 54 | 51 | 48 |
| iHc (kOe) | 14.5 | 15.8 | 22 | 24 | 26 | 27 | 26 | 24 | 16 |
| Weight increase before and after vapor processi-ng (wt%) | — | 0.01 | 0.05 | 0.1 | 0.3 | 0.4 | 0.6 | 0.8 | 1.5 |
| | Comparative Example | | Present Invention | | | | | | Comparative Example |

[Fig. 11]

| | | Temperature of vapor processing (℃) | | | | | | | |
|---|---|---|---|---|---|---|---|---|---|
| | Not-vapor proces-sing | 850 | 900 | 950 | 1000 | 1050 | 1100 | 1150 | 1200 |
| Br (kG) | 14.2 | 14.3 | 14.6 | 14.7 | 15.3 | 15.4 | 14.7 | 14.6 | 13 |
| (BH)max (MGOe) | 49 | 49.5 | 50 | 52 | 57.4 | 58.1 | 54 | 51 | 40 |
| iHc (kOe) | 14.5 | 15.8 | 21 | 23 | 29 | 30 | 29 | 28 | 8 |
| | Comparative Example | | Present Invention | | | | | | Comparative Example |

[Fig. 12]

| | Average grain diameter of sintered magnet (μ m) | | | | | |
|---|---|---|---|---|---|---|
| | 0.5 | 1 | 2 | 3 | 4 | 5 |
| Br (kG) | 13.9 | 14.3 | 14.4 | 14.6 | 14.6 | 14.3 |
| (BH)max (MGOe) | 46.5 | 50.5 | 51 | 52.8 | 52.2 | 50.5 |
| iHc (kOe) | 40 | 36 | 34 | 32 | 31 | 30 |
| Optimum diffusing process hour (hr) | 72 | 36 | 18 | 12 | 8 | 8 |
| | Comparative Example | Present Invention | | | | |

[Fig. 12 (continued)]

| Average grain diameter of sintered magnet (μ m) | | | | | | | | |
|---|---|---|---|---|---|---|---|---|
| 6 | 7 | 8 | 9 | 10 | 12 | 15 | 20 | 25 |
| 14.1 | 14.4 | 14.8 | 15 | 15.1 | 15.2 | 15.2 | 15.2 | 13.8 |
| 48 | 51 | 54 | 55.1 | 55 | 56 | 56 | 56 | 46 |
| 27 | 30 | 32 | 32 | 32 | 32 | 31 | 30 | 25 |
| 6 | 4 | 2 | 1 | 1 | 1 | 0.5 | 0.5 | 1 |
| Comparative Example | Present Invention | | | | | | | Comparative Example |

[Fig. 13]

| | Vacuum vapor processing | Component of magnet | Optimum vapor processing time | Br (kG) | (BH)max (MGOe) | iHc (kOe) | Evaluation of corrosion resistance |
|---|---|---|---|---|---|---|---|
| Embodiment 8 | Not performed | 28Nd-1B-0.05Cu-0.05Ga-0.1Zr-bal. Fe | — | 14.4 | 51.2 | 11.4 | 6 hr or less |
| | Performed | | 2 | 15.4 | 58 | 19.5 | 120 hr or more |
| Comparative Example 8a | Not performed | 28Nd-1Co-1B-0.05Cu-0.05Ga-0.1Zr-bal. Fe | — | 14.3 | 51 | 11.3 | 24 hr or less |
| | Performed | | 10 | 15.2 | 57 | 18.2 | 120 hr or more |
| Comparative Example 8b | Not performed | 28Nd-4Co-1B-0.05Cu-0.05Ga-0.1Zr-bal.Fe | — | 14.4 | 52 | 11.1 | 48 hr or more |
| | Performed | | 22 | 15.1 | 55 | 17.4 | 120 hr or more |
| Comparative Example 8c | Not performed | 28Nd-8Co-1B-0.05Cu-0.05Ga-0.1Zr-bal. Fe | — | 14.4 | 52 | 11 | 72 hr or more |
| | Performed | | 32 | 15 | 54 | 17 | 120 hr or more |

[Fig. 14]

| | | Temperature of sintered magnet (℃) | | | | |
|---|---|---|---|---|---|---|
| | Temperature of processing chamber (℃) | 750 | 800 | 850 | 900 | 950 |
| Br (kG) | 900 | 14.3 | 14.6 | 14.7 | 14.8 | 14.9 |
| (BH)max (MGOe) | | 49.5 | 50 | 52 | 54 | 56 |
| iHc (kOe) | | 15.8 | 21 | 23 | 24 | 26 |
| Br (kG) | 850 | 14.3 | 14.6 | 14.7 | 14.8 | 14.9 |
| (BH)max (MGOe) | | 49.5 | 50 | 52 | 54 | 56 |
| iHc (kOe) | | 15.8 | 22 | 24 | 26 | 27 |
| Br (kG) | 800 | 14.3 | 14.6 | 14.7 | 14.8 | 14.9 |
| (BH)max (MGOe) | | 49.5 | 50 | 52 | 54 | 56 |
| iHc (kOe) | | 15.8 | 22 | 24 | 26 | 27 |
| Br (kG) | 750 | 14.3 | 14.6 | 14.7 | 14.8 | 14.9 |
| BH)max (MGOe) | | 49.5 | 50 | 52 | 54 | 56 |
| iHc (kOe) | | 15.8 | 22 | 24 | 26 | 27 |
| | | Comparative Example | Present Invention | | | |

[Fig. 14 (Continued)]

| Temperature of sintered magnet (℃) | | | | | |
|---|---|---|---|---|---|
| 1000 | 1050 | 1100 | 1150 | 1200 | 1250 |
| 14.7 | 14.6 | 14 | 13.5 | 12 | 11 |
| 54 | 51 | 48 | 44 | 30 | 21 |
| 25 | 23 | 21 | 12 | 8 | 4 |
| 14.7 | 14.6 | 14 | 13.5 | 12 | 11 |
| 54 | 51 | 48 | 44 | 30 | 21 |
| 26 | 24 | 22 | 12 | 8 | 4 |
| 14.7 | 14.6 | 14 | 13.5 | 12 | 11 |
| 54 | 51 | 48 | 44 | 30 | 21 |
| 26 | 24 | 22 | 12 | 8 | 4 |
| 14.7 | 14.6 | 14 | 13.5 | 12 | 11 |
| 54 | 51 | 48 | 44 | 30 | 21 |
| 26 | 25 | 24 | 12 | 8 | 4 |
| Present Invention | | | Comparative Example | | |

[Fig. 15]

| | Average grain diameter of sintered magnet (μ m) | | | | | |
|---|---|---|---|---|---|---|
| | 0.5 | 1 | 2 | 3 | 4 | 5 |
| Br (kG) | 13.9 | 14.4 | 14.4 | 14.7 | 14.7 | 14.4 |
| (BH)max (MGOe) | 46.5 | 51.5 | 52 | 53.6 | 53.3 | 51.5 |
| iHc (kOe) | 36 | 34 | 32 | 30 | 29 | 28 |
| Optimum diffusing process hour (hr) | 72 | 36 | 18 | 12 | 8 | 8 |
| | Comparative Example | Present Invention | | | | |

[Fig. 15 (continued)]

| Average grain diameter of sintered magnet (μ m) | | | | | | | | |
|---|---|---|---|---|---|---|---|---|
| 6 | 7 | 8 | 9 | 10 | 12 | 15 | 20 | 25 |
| 14.1 | 14.5 | 14.9 | 15.1 | 15.2 | 15.3 | 15.3 | 15.3 | 13.8 |
| 48 | 52 | 55 | 56.1 | 56 | 57 | 57 | 57 | 46 |
| 25 | 28 | 30 | 30 | 30 | 30 | 29 | 28 | 23 |
| 6 | 4 | 2 | 1 | 1 | 1 | 0.5 | 0.5 | 1 |
| Comparative Example | Present Invention | | | | | | | Comparative Example |

[Fig. 16]

| | Vacuum vapor processing | Compo-ent of magnet | Optimum vapor processi n-g time | Br (kG) | (BH)max (MGOe) | iHc (kOe) | Evaluat i-on of corrosio -n resistan -ce |
|---|---|---|---|---|---|---|---|
| Embodi -ment 11 | Not-performed | 21Nd-7 Pr-1B-0 .05Cu-0 .05Ga-0 .1Zr-bal . Fe | — | 14.4 | 51.2 | 10.8 | 2 hr or less |
| | Performed | | 4 | 15.4 | 58 | 20.5 | 120 hr or more |
| Compar -ative Exampl e 11a | Not-performed | 21Nd-7 Pr-1Co-1B-0.05 Cu-0.05 Ga-0.1 Zr-bal. Fe | — | 14.3 | 51 | 11.2 | 12 hr or less |
| | Performed | | 10 | 15.2 | 57 | 18.2 | 120 hr or more |
| Compar -ative Exampl e 11b | Not-performed | 21Nd-7 Pr-4Co-1B-0.05 Cu-0.05 Ga-0.1 Zr-bal. Fe | — | 14.4 | 52 | 11.0 | 36 hr or more |
| | Performed | | 22 | 15.1 | 55 | 17.4 | 120 hr or more |
| Compar -ative Exampl e 11c | Not-performed | 21Nd-7 Pr-8Co-1B-0.05 Cu-0.05 Ga-0.1 Zr-bal. Fe | — | 14.4 | 52 | 10.8 | 48 hr or more |
| | Performed | | 32 | 15 | 54 | 16 | 120 hr or more |

[Fig. 17]

| | | | Temperature of heat treatment | | | | | | |
|---|---|---|---|---|---|---|---|---|---|
| | | Not-heat treatment | 400 | 450 | 500 | 550 | 600 | 650 | 700 |
| Sample 1 | Br (kG) | 14.4 | 14.4 | 14.5 | 14.6 | 14.6 | 14.6 | 14.5 | 14.4 |
| | (BH)max (MGOe) | 50.8 | 50.8 | 51.1 | 53.5 | 53.8 | 53.3 | 52.1 | 50.8 |
| | iHc (kOe) | 5.2 | 6.3 | 7.1 | 8.4 | 8.6 | 8.3 | 8.1 | 7.8 |
| Sample 2 | Br (kG) | 14.8 | 14.8 | 14.8 | 14.8 | 14.8 | 14.8 | 14.8 | 14.8 |
| | (BH)max (MGOe) | 53.7 | 53.7 | 53.7 | 53.7 | 53.7 | 53.7 | 53.7 | 53.7 |
| | iHc (kOe) | 12.1 | 18.2 | 20.5 | 22.1 | 24.6 | 26.5 | 24.8 | 23.6 |

[Fig. 18]

| | Degree of vacuum | | | | | | | |
|---|---|---|---|---|---|---|---|---|
| | 10 Pa | 1 Pa | $10^{-1}$ | $10^{-2}$ | $10^{-3}$ | $10^{-4}$ | $10^{-5}$ | $10^{-6}$ |
| Br (kG) | 14.2 | 14.8 | 14.8 | 14.8 | 14.8 | 14.8 | 14.8 | 14.8 |
| (BH)max (MGOe) | 49.0 | 53.1 | 53.3 | 53.7 | 53.7 | 53.7 | 53.7 | 53.7 |
| iHc (kOe) | 12.0 | 18.2 | 20.1 | 22.9 | 24.8 | 26.1 | 26.3 | 26.4 |
| | Comparative Example | Present Invention | | | | | | |

[Fig. 19]

| | | | Heating temperature of metallic material (℃) | | | |
|---|---|---|---|---|---|---|
| | | Temperature of magnet (℃) | 750 | 800 | 850 | 900 |
| Comparative Example | Br (kG) | 1150 | 13.5 | 11.0 | 10.5 | 10.5 |
| | (BH)max (MGOe) | | 30.1 | 25.1 | 24.7 | 24.4 |
| | iHc (kOe) | | 8.9 | 6.9 | 6.9 | 7.0 |
| Present Invention | Br (kG) | 1100 | 14.3 | 14.4 | 14.4 | 14.4 |
| | (BH)max (MGOe) | | 49.5 | 49.9 | 52.0 | 54.0 |
| | iHc (kOe) | | 12.3 | 17.9 | 23.9 | 26.0 |
| | Br (kG) | 1000 | 14.3 | 14.6 | 14.6 | 14.8 |
| | (BH)max (MGOe) | | 49.5 | 49.8 | 51.9 | 54.0 |
| | iHc (kOe) | | 12.1 | 18.9 | 24.0 | 26.0 |
| | Br (kG) | 900 | 14.3 | 14.6 | 14.7 | 14.8 |
| | (BH)max (MGOe) | | 49.5 | 49.8 | 51.8 | 53.9 |
| | iHc (kOe) | | 12.2 | 16.5 | 23.3 | 25.5 |
| | Br (kG) | 800 | 14.3 | 14.6 | 14.6 | 14.6 |
| | (BH)max (MGOe) | | 49.5 | 49.9 | 52.0 | 53.7 |
| | iHc (kOe) | | 12.0 | 17.0 | 23.9 | 25.9 |
| Comparative Example | Br (kG) | 750 | 14.3 | 14.3 | 14.3 | 14.3 |
| | (BH)max (MGOe) | | 49.5 | 49.2 | 49.3 | 49.3 |
| | iHc (kOe) | | 12.1 | 11.9 | 12.0 | 12.1 |
| | | | Comparative Example | Present Invention | | |

[Fig. 19 (Continued)]

| Heating temperature of metallic material (℃) | | | | | | |
|---|---|---|---|---|---|---|
| 950 | 1000 | 1050 | 1100 | 1150 | 1200 | 1250 |
| 10.7 | 10.8 | 11.0 | 10.7 | 10.7 | 10.9 | 9.8 |
| 24.3 | 23.5 | 23.2 | 22.1 | 21.5 | 21.3 | 16.9 |
| 6.9 | 6.9 | 7.0 | 7.0 | 6.3 | 5.2 | 3.0 |
| 14.4 | 14.3 | 14.3 | 14.3 | 14.2 | 14.0 | 11.0 |
| 56.0 | 53.9 | 49.8 | 49.5 | 48.3 | 48.0 | 21.0 |
| 26.9 | 26.7 | 26.0 | 25.9 | 23.9 | 15.9 | 14.3 |
| 14.9 | 14.7 | 14.3 | 14.4 | 14.3 | 14.0 | 11.0 |
| 56.0 | 53.9 | 50.9 | 49.5 | 49.2 | 47.8 | 20.9 |
| 26.9 | 26.3 | 26.3 | 26.0 | 23.9 | 16.0 | 15.3 |
| 14.9 | 14.7 | 14.6 | 14.4 | 14.4 | 14.0 | 12.5 |
| 56.0 | 53.9 | 50.8 | 50.2 | 50.1 | 48.0 | 36.3 |
| 26.5 | 26.0 | 25.7 | 25.6 | 23.8 | 15.9 | 15.5 |
| 14.7 | 14.7 | 14.6 | 14.6 | 14.4 | 14.0 | 13.1 |
| 55.9 | 53.8 | 52.8 | 52.1 | 50.3 | 47.9 | 39.1 |
| 26.9 | 25.8 | 25.4 | 24.8 | 23.9 | 15.9 | 15.4 |
| 14.3 | 14.3 | 14.3 | 14.3 | 14.3 | 14.3 | 12.3 |
| 49.3 | 49.2 | 49.3 | 49.2 | 49.2 | 49.2 | 20.9 |
| 12.0 | 11.9 | 11.9 | 11.9 | 11.9 | 11.9 | 11.9 |
| Present Invention | | | | | | Comparative Example |

PERMANENT MAGNET AND A MANUFACTURING METHOD THEREOF

This application is a national phase entry under 35 U.S.C. §371 of PCT Patent Application No. PCT/JP2007/066272, filed on Aug. 22, 2007, which claims priority under 35 U.S.C. §119 to Japanese Patent Application Nos. 2006-227122, filed Aug. 23, 2006, 2006-227123, filed Aug. 23, 2006, 2006-245302, filed on Sep. 11, 2006, and 2006-246248, filed on Sep. 12, 2006, all of which is incorporated by reference.

FIELD OF THE INVENTION

The present invention relates to a permanent magnet and a method for manufacturing the permanent magnet, and more particularly to a permanent magnet having high magnetic properties in which Dy or Tb is diffused into grain boundary phases of a sintered magnet of Nd—Fe—B family and method for manufacturing such a permanent magnet.

DESCRIPTION OF BACKGROUND ART

The sintered magnet of Nd—Fe—B family (the so-called neodymium magnet) comprises a combination of Fe, Nd and B which are cheap, abundant and constantly obtainable resources and thus can be manufactured at a low cost and additionally has high magnetic properties (its maximum energy product is about 10 times that of ferritic magnet). Accordingly the sintered magnet of Nd—Fe—B family has been used in various kinds of articles such as electronic instruments and in recently adopted in motors and electric generators for hybrid cars.

On the other hand, since the Curie temperature of the sintered magnet of Nd—Fe—B family is low (about 300° C.), there is a problem the sintered magnet of Nd—Fe—B family would be demagnetized by heat when heated to a temperature exceeding a predetermined temperature under a certain circumstantial condition in its adopted articles. In addition there is further problem that the magnetic properties would be extremely deteriorated by defects (e.g. cracks etc.) or strains in grains of the sintered magnet which are sometimes caused when the sintered magnet is machined to a desired configuration suitable for a particular article.

For solving these problems mentioned above, it is known to improve or recover the magnetizing properties and coercive force by arranging rare earth elements selected from Yb, Eu and Sm in a processing chamber under a condition mingled with a sintered magnet of Nd—Fe—B family, evaporating rare earth elements by heating the processing chamber, attaching the evaporated atoms of the rare earth elements into the sintered magnet, and further diffusing the attached atoms into the grain boundary phases of the sintered magnet in order to homogeneously introduce desired amount of the rare earth elements into a surface of the sintered magnet and the grain boundary phases (Patent Document 1 mentioned below).

It is also known that Dy and Tb of the rare earth elements have the magnetic anisotropy of 4f electron larger than that of Nd and a negative Stevens factor similarly to Nd and thus can remarkably improve the grain magnetic anisotropy of principal phase. However since Dy and Tb take a ferrimagnetism structure having a spin orientation negative to that of Nd in the crystal lattice of the principal phase, the strength of magnetic field, accordingly the maximum energy product exhibiting the magnetic properties is extremely reduced. Thus it has been proposed to homogeneously introduce a desired amount of Dy and Tb especially into the grain boundary phases in accordance with the method mentioned above.

[Patent Document 1] Japanese Laid-open Patent Publication No. 296973/2004 (e.g. refer to descriptions in claims thereof)

DISCLOSURE OF THE INVENTION

Problems to be Solved by the Invention

However as it is a fact that there exist Dy and Tb on the surface of sintered magnet manufactured by the method of the prior art mentioned above (i.e. as there are formed thin films of Dy or Tb the surface of sintered magnet), there would be caused a problem that metal atoms deposited on the surface of sintered magnet recrystallize thereon and thus extremely deteriorate the surface of the sintered magnet (i.e. deteriorate the surface roughness). In the method of the prior art in which the rare earth elements and the sintered magnet are arranged in a mingled condition, it is inevitable of formations of thin films or projections on the surface of sintered magnet since rare earth elements melted during heating of the metal evaporating material are directly deposited on the surface of sintered magnet.

Similarly to the formation of thin films of Dy and Tb on the surface of sintered magnet, Dy and Tb will be deposited on the surface of sintered magnet heated during the processing thereof when excessive metal atoms are supplied on the surface of sintered magnet, and the melting point near the surface is lowered due to increase of amount of Dy and Tb and accordingly Dy and Tb deposited on the surface are melted and then excessively enter into the grains near the surface of sintered magnet. When Dy and Tb excessively enter into the grains, since they, as described above, take a ferrimagnetism structure having a spin orientation negative to that of Nd in the crystal lattice of the principal phase, it would be afraid that the magnetizing properties and coercive force cannot be effectively improved or recovered.

That is, when thin films of Dy or Tb are once formed on the surface of sintered magnet, the average composition of the surface sintered magnet adjacent to the thin films will be rare earth element-rich composition, and the liquid phase temperature will be lowered and thus the surface of sintered magnet will be melted when the surface of sintered magnet becomes the rare earth element-rich composition (i.e. the principal phase is melted and an amount of the liquid phase is increased). As the result of which a region near the surface of sintered magnet will be melted and damaged and accordingly irregularity of the surface will be also increased. Additionally Dy will excessively enter into grains together with a large amount of liquid phase and thus the maximum energy product exhibiting the magnetic properties and the remanent flux density will be further lowered.

If thin films or projections are formed on the surface of sintered magnet and the surface (the surface roughness) is deteriorated or Dy and Tb are excessively entered into grains near the surface of sintered magnet, a subsequent working process (finishing work to remove the defects) is required. This would decrease manufacturing yield and increases manufacturing steps and thus manufacturing costs.

It is, therefore, a first object of the present invention to provide method for manufacturing a permanent magnet which can efficiently diffuse Dy and Tb into grain boundary phases without deteriorating a surface of sintered magnet of Nd—Fe—B family, effectively improve or recover the magnetizing properties and coercive force, and eliminate any subsequent working process. It is also a second object of the present invention to provide a permanent magnet having high magnetic properties and strong corrosion resistance in which Dy and Tb are efficiently diffused only into grain boundary phases of a sintered magnet of Nd—Fe—B family having a predetermined configuration.

Means for Solving the Problems

For achieving the first object mentioned above, there is provided, according to the present invention of claim 1, method for manufacturing a permanent magnet comprising steps of heating a sintered magnet of Fe—B-rare earth elements family arranged in a processing chamber to a predetermined temperature and evaporating metal evaporating material including at least one of Dy and Tb arranged in said processing chamber or another processing chamber; depositing evaporated metal atoms onto a surface of the sintered magnet with controlling a supplying amount of the metal atoms; and diffusing the deposited metal atoms into grain boundary phases of the sintered magnet before formation of thin film of the metal evaporating material on the surface of the sintered magnet.

According to the present invention, evaporated metal atoms including at least one of Dy and Tb are supplied onto the surface of sintered magnet heated to a predetermined temperature and deposited thereon. During which since the sintered magnet is heated to a temperature at which an optimum diffusing velocity can be obtained and the amount of Dy and Tb supplied onto the surface of sintered magnet is controlled, the metal atoms deposited on the surface can be diffused in order into grain boundary phases of the sintered magnet before formation of the thin film. That is, the supply of Dy and Tb onto the surface of sintered magnet and the diffusion of the sintered magnet into the grain boundary phases are performed through single process. Thus deterioration of the surface (surface roughness) of permanent magnet can be prevented and especially excessive diffusion of Dy and Tb into grains near the surface of sintered magnet can be suppressed.

Accordingly the surface condition of the permanent magnet is substantially same as that before the process has been performed and thus any subsequent working process is not required. In addition Dy/Tb-rich phases (phases including Dy and Tb in a range of 5%~80%) are generated by diffusing and homogeneously penetrating Dy and Tb into grain boundary phases. As the result of which it is possible to obtain a permanent magnet of high magnetic properties of which the magnetizing properties and coercive force are improved or recovered. In addition if defects (cracks) have been generated in grains near the surface of sintered magnet during processing of the sintered magnet, Dy/Tb-rich phases are formed inside the cracks and thus the magnetizing properties and coercive force can be recovered.

In the present invention it is preferable that the processing chamber is heated to a temperature in a range of 800° C.~1050° C. under a vacuum condition when the sintered magnet of Fe—B-rare earth elements family and the metal evaporating material having a primary component of Dy are arranged in the processing chamber. The setting of the temperature in a range of 800° C.~1050° C. enables to suppress both the vapor pressure of the metal evaporating material and the supplying amount of the metal atoms onto the surface of sintered magnet and additionally the sintered magnet is heated to a temperature promoting the diffusing velocity. Accordingly Dy atoms deposited on the surface of sintered magnet can be diffused and homogeneously penetrated into the grain boundary phases of sintered magnet before they form a thin form of Dy on the surface of sintered magnet.

If the temperature in the processing chamber is lower than 800° C., the vapor pressure cannot reach a level which can supply Dy atoms onto the surface of sintered magnet so that Dy can be diffused and homogeneously penetrated into the grain boundary phases. In addition the diffusing velocity of Dy atoms deposited on the surface of sintered magnet into the grain boundary phases is decreased. On the other hand if the temperature exceeds 1050° C., the vapor pressure of Dy is increased and thus Dy atoms in vapor atmosphere are excessively supplied onto the surface of sintered magnet. In addition it is afraid that Dy would be excessively diffused into grains and since the magnetizing properties in grains are extremely reduced if Dy is excessively diffused into grains, the maximum energy product and the remanent flux density are further reduced.

On the other hand it is preferable that the processing chamber is heated to a temperature in a range of 900° C.~1150° C. under a vacuum condition when the sintered magnet of Fe—B-rare earth elements family and the metal evaporating material having a primary component of Tb are arranged in the processing chamber. Similarly to the effects described above, this makes it possible that the Tb atoms deposited on the surface of sintered magnet are diffused and homogeneously penetrated into the grain boundary phases of sintered magnet before they form the thin film of Tb on the surface of sintered magnet, that Tb-rich phase is generated in the grain boundary phase, and that Tb is diffused only into a region near the surface of grains. As the result of which it is possible to obtain a permanent magnet of high magnetic properties having effectively improved or recovered magnetizing properties and coercive force.

If the temperature in the processing chamber is lower than 900° C., the vapor pressure cannot reach a level which can supply Tb atoms onto the surface of sintered magnet so that Tb can be diffused and homogeneously penetrated into the grain boundary phases. On the other hand if the temperature exceeds 1150° C., the vapor pressure of Tb is increased and thus Tb atoms in vapor atmosphere are excessively supplied onto the surface of sintered magnet.

Also in the present invention, it may be possible that the method for manufacturing a permanent magnet comprises steps of arranging the sintered magnet of Fe—B-rare earth elements family in the processing chamber and heating the sintered magnet to a temperature in a range of 800° C.~1100° C.; heating and evaporating the metal evaporating material including at least one of Dy and Tb arranged in said processing chamber or another processing chamber; and supplying and depositing the evaporated metal atoms onto the surface of the sintered magnet. This enables to increase the diffusing velocity and to efficiently diffuse in order Dy and Tb deposited on the surface of the sintered magnet into the grain boundary phases of sintered magnet.

If the temperature of the sintered magnet is lower than 800° C., it is afraid that the thin film of metal evaporating material is formed on the surface of sintered magnet since a diffusing velocity sufficient to diffuse and homogeneously penetrate Dy and Tb into grain boundary phase of sintered magnet. On the other hand if the temperature exceeds 1100° C., Dy and Tb enter into grains which is the principal phase of sintered magnet. This is after all same condition as that in which Dy and Tb are added during obtaining the sintered magnet and thus it is afraid that the strength of magnetic field accordingly the maximum energy product exhibiting the magnetic properties would be extremely reduced.

Further in the present invention, it may be possible that method for manufacturing a permanent magnet comprises steps of arranging the sintered magnet of Fe—B-rare earth elements family in the processing chamber; heating and evaporating the metal evaporating material including at least one of Dy and Tb arranged in said processing chamber or another processing chamber to a temperature in a range of 800° C.~1200° C. after heating and holding the sintered magnet to a predetermined temperature; and supplying and depositing the evaporated metal atoms onto the surface of the sintered magnet. Under this condition, since the metal evaporating material can be heated and evaporated in the range of 800° C.~1200° C., the metal atoms of Dy and Tb can be supplied onto the surface of sintered magnet in proper quantities in accordance with the vapor pressure at that time If the temperature of the metal evaporating material is lower than 800° C., the vapor pressure cannot reach a level which can supply the metal atoms of Dy and Tb onto the surface of sintered magnet so that Dy and Tb can be diffused and homogeneously penetrated into the grain boundary phases. On the other hand if the temperature exceeds 1200° C., the vapor pressure of the metal evaporating material becomes too high and Dy and Tb atoms in vapor atmosphere are excessively supplied onto the surface of sintered magnet. Thus it is afraid that the thin film of the metal evaporating material would be formed on the surface of sintered magnet.

It may be possible that the sintered magnet and the metal evaporating material are arranged apart from each other. This is preferable so as to prevent melted metal evaporating material from being directly stuck to the sintered magnet when the metal evaporating material is evaporated.

In order to diffuse the metal evaporating material into the grain boundary phases before the thin film of Dy and Tb is formed on the surface of sintered magnet, it is preferable that a ratio of the total surface area of the metal evaporating material to the total surface area of the sintered magnet arranged in the processing chamber is set in a range of $1\times10^{-4}\sim2\times10^{3}$.

It may be possible that the supplying amount of the metal atoms is controlled by changing the specific surface area of the metal evaporating material arranged in the processing chamber to increase and decrease the amount of evaporation of the metal evaporating material under a constant temperature. This makes it possible to simply control the supplying amount of metal atoms onto the surface of sintered magnet without changing any structure of the apparatus e.g. providing separate parts in the processing chamber for increasing and decreasing the supplying amount of Dy and Tb onto the surface of sintered magnet.

In order to remove soil, gas or moisture adsorbed on the surface of sintered magnet before Dy and Tb are diffused into the grain boundary phases, it is preferable the pressure in the processing chamber is kept at a predetermined reduced pressure before heating of the processing chamber containing the sintered magnet.

In this case, in order to promote the removal of soil, gas or moisture adsorbed on the surface of sintered magnet, it is preferable that the temperature in the processing chamber is kept at a predetermined temperature after reducing the pressure in the process chamber to a predetermined pressure.

In order to remove a oxide film on the surface of sintered magnet before Dy and Tb are diffused into the grain boundary phases, it is preferable that the surface of the sintered magnet is cleaned with using plasma before heating of the processing chamber containing the sintered magnet.

It is preferable that heat treatment of the sintered magnet is performed at a temperature lower than said temperature after diffusing the metal atoms into grain boundary phases of the sintered magnet. This enables to obtain a permanent magnet of high magnetic properties having further improved and recovered magnetizing properties and coercive force.

It is preferable that the sintered magnet has an average diameter of grain of 1 μm~5 μm or 7 μm~20 μm. If the average diameter of grain is larger than 7 μm, since the spinning force of the grains during generation of the magnetic field is increased, the degree of orientation is improved and additionally the surface area of grain boundary phases is reduced, it is possible to efficiently diffuse Dy and Tb deposited on the surface of sintered magnet and thus to obtain a permanent magnet having a remarkably high coercive force.

If the average diameter of grain is larger than 25 μm, the rate in the grain boundary of grains including different grain orientation is extremely increased and the degree of orientation is deteriorated and as the result of which the maximum energy product, remanent flux density and the coercive force are reduced. On the other hand if the average diameter of grain is smaller than 5 μm, the rate of single domain grains is increased and as the result of which a permanent magnet having very high coercive force. If the average diameter of grain is smaller than 1 μm, since the grain boundary becomes small and complicated, Dy and Tb cannot be efficiently diffused.

It is preferable that the sintered magnet does not contain Co. Co has been added in the neodymium magnet of the prior art to prevent corrosion of the magnet. In the present invention, the metal atoms of Dy and Tb deposited on the surface of sintered magnet can be efficiently diffused during diffusing at least one of Dy and Tb. This is because of absence of intermetallic compound including Co in the grain boundary of the sintered magnet. In addition, since Dy/Tb-rich phases having extremely high corrosion resistance and atmospheric corrosion resistance as compared with Nd is formed inside of defects (cracks) generated in grain near the surface of sintered magnet during process of the sintered magnet, it is possible to obtain a permanent magnet having extremely strong corrosion resistance and atmospheric corrosion resistance.

For achieving the second object mentioned above, there is provided, according to the present invention of claim 15, a permanent magnet comprising a sintered magnet of Fe—B-rare earth elements family and manufactured by evaporating metal evaporating material including at least one of Dy and Tb, depositing evaporated metal atoms onto a surface of the sintered magnet with controlling a supplying amount of the metal atoms; and diffusing the deposited metal atoms into grain boundary phases of the sintered magnet before formation of thin film of the metal evaporating material on the surface of the sintered magnet.

In this case it is preferable that the sintered magnet has an average diameter of grain of 1 μm~5 μm or 7 μm~20 μm.

It is also preferable that the sintered magnet does not contain Co.

Effects of the Invention

As described above, the method for manufacturing a permanent magnet of the present invention can efficiently diffuse Dy and Tb into the grain boundary phases without deteriorating the surface of the sintered magnet of Nd—Fe—B family and effectively improve and recover the magnetizing properties and coercive force. These effects, in combination with other effects that the supply of Dy and Tb onto the surface of sintered magnet and the diffusion of them into the grain boundary phases can be performed by single process as well as that the subsequent working process is not required, can exhibit a superior effect of improving the productivity. In addition the permanent magnet of the present invention can also exhibit a superior effect of providing a high magnetic properties and a strong corrosion resistance.

BEST MODE FOR CARRYING OUT THE INVENTION

With reference to FIGS. 1 and 2, a permanent magnet M of the present invention can be manufactured by simultaneously performing a series of processes (vacuum vapor processing) of evaporating metal evaporating material V including at least one of Dy and Tb onto a surface of a sintered magnet S of Nd—Fe—B family machined as having a predetermined configuration, depositing the evaporated metal atoms onto the surface of sintered magnet S, and diffusing and homogeneously penetrating the metal atoms into grain boundary phases of the sintered magnet S.

The sintered magnet S as starting material of Nd—Fe—B family has been manufactured as following by a known method. That is, firstly an alloy member having a thickness of 0.05 mm~0.5 mm is manufactured by the known strip casting method with formulating Fe, B and Nd at a predetermined composition. An alloy member having a thickness of 5 mm may be manufactured by the known centrifugal casting method. A small amount of Cu, Zr, Dy, Tb, Al or Ga may be added therein during the formulation. Then the manufactured alloy member is once ground by the known hydrogen grinding process and then pulverized by the jet-mill pulverizing process.

The sintered magnet mentioned above can be manufactured by forming the ground material to a predetermined configuration such as a rectangular parallelopiped or a cylinder in a mold with using magnetic field orientation. It may be possible to further improve the magnetic properties when performed the vacuum vapor processing on the sintered magnet if the sintered magnet S has been heat treated to remove its strain for a predetermined period (e.g. two hours) under a predetermined temperature (400° C.~700° C.) after the sintering process.

It is preferable to optimize conditions in each manufacturing step of the sintered magnet S so that the average grain diameter has a range of 1 μm~5 μm or 7 μm~20 μm. If the average diameter of grain is larger than 7 μm, since the spinning force of the grains during generation of the magnetic field is increased, the degree of orientation is improved and additionally the surface area of grain boundary phases is reduced, it is possible to efficiently diffuse at least one of Dy and Tb and thus to obtain a permanent magnet M having a remarkably high coercive force. If the average diameter of grain is larger than 25 μm, the rate in the grain boundary of grains including different grain orientation in one grain is extremely increased and the degree of orientation is deteriorated and as the result of which the maximum energy product, remanent flux density and the coercive force are reduced.

On the other hand if the average diameter of grain is smaller than 5 μm, the rate of single domain grains is increased and as the result of which a permanent magnet having very high coercive force. If the average diameter of grain is smaller than 1 μm, since the grain boundary becomes small and complicated, the time required for performing the diffusing process must be extremely extended and thus the productivity is worsened.

It is possible to use as the metal evaporating material V an alloy including at least one of Dy and Tb remarkably improving the grain magnetic anisotropy of principal phase. In this case it may be possible to include therein Nd, Pr, Al, Cu, Ga etc. in order to further improve the coercive force. In addition the metal evaporating material V is made as a bulky alloy formulated at a predetermined mixing ratio and heated e.g. in an arc furnace and then arranged in the processing chamber described below.

As shown in FIG. 2, a vacuum vapor processing apparatus 1 comprises has a vacuum chamber 12 in which a pressure can be reduced and kept at a predetermined pressure (e.g. $1\times10^{-5}$ Pa) via an evacuating means such as turbo-molecular pump, cryopump, diffusion pump etc. There is arranged in the vacuum chamber 12 a box 2 comprising a rectangular parallelopiped box body 21 having an open top and a lid 22 detachable on the open top of the box body 21.

A downwardly bent flange 22*a* formed around the lid 22 can be fitted on the top of the box body 21 to define a processing chamber 20 isolated from the vacuum chamber 12 (any vacuum seal such as a metal seal is not between the flange 22*a* and the box body 21). A pressure in the processing chamber 20 can be reduced to a pressure (e.g. $5\times10^{-4}$ Pa) higher substantially by half-digit than that in the vacuum chamber 12 by reducing the pressure in the vacuum chamber 12 to a predetermined pressure (e.g. $1\times10^{-5}$ Pa) via the evacuating means 11.

A volume of the processing chamber 20 is determined so that the metal atoms can be supplied onto the sintered magnet S directly or from a plurality of directions after several collisions in consideration of the average free stokes of evaporated metal material. The box body 21 and the lid 22 are made of materials not reacting with the metal evaporating member and their wall thickness is determined so that they are not deformed by heat when they are heated by a heating means described below.

When the metal evaporating material V is Dy and Tb, it is afraid that Dy and Tb in the vapor atmosphere would react with $Al_2O_3$ and form products of reaction on the box 2 when the box 2 is made of $Al_2O_3$ often used in general vacuum apparatus and atoms of Al would enter into the vapor atmosphere of Dy and Tb. Accordingly the box 2 is made of Mo, W, V, Ta or these alloys (including rare earth elements added Mo alloy, Ti added Mo alloy etc.), CaO, $Y_2O_3$ or oxides of rare earth elements or structured by heat insulation member on which said elements or alloys are coated as inner lining. A bearing grid 21*a* for example of plurality of Mo wires (e.g. 0.1 mm~10 mm Φ) is arranged at a predetermined height in the processing chamber 20 on which a plurality of sintered magnets S can be placed side by side. On the other hand, the metal evaporating materials V are appropriately placed on a bottom surface, side surfaces or a top surface of the processing chamber 20.

A heating means 3 is arranged in the vacuum chamber 12. Similarly to the box 2 the heating means 3 is made of material which does not react with metal evaporating material of Dy and Tb and arranged so that it encircles the box 2 and comprises a heat insulation member of Mo on which inner surface is provided with a reflecting surface and an electric heater formed of a Mo filament mounted on the inner surface of the heat insulation member. The processing chamber 20 can be substantially uniformly heated by heating the box 2 under a vacuum condition with using the heating means 3 and indirectly heating the inside of the processing chamber 20 via the box 2.

Then manufacture of the permanent magnet M with using the vacuum vapor processing apparatus 1 and performing the method of the present invention. First of all, sintered magnets S made in accordance with the method described above are placed on the bearing grid 21*a* of the box body 21 and Dy forming the metal evaporating materials V is placed on the bottom surface of the box body 21 (Thus the sintered magnets S and the metal evaporating materials V are arranged away from each other in the processing chamber 20). After having closed the open top of the box body 21 by the lid 22, the box 2 is placed on a predetermined position encircled by the heating means 3 in the vacuum chamber 12 (see FIG. 2). Then evacuating the vacuum chamber 12 to a predetermined pressure (e.g. $1\times10^{-4}$ Pa) via the evacuating means 11 (the processing chamber 20 is evacuated to a pressure of half-digit higher than $1\times10^{-4}$ Pa) and heating the processing chamber 20 with actuation of the heating means 3 when the vacuum chamber 12 has reached to a predetermined pressure.

When the temperature in the processing chamber 20 has reached to a predetermined temperature under the evacuated condition, Dy placed on the bottom surface of the processing chamber 20 is heated to a temperature substantially same as that of the processing chamber 20 and commences the evaporation and accordingly a Dy vapor atmosphere is formed in the processing chamber. Since the sintered magnets S and Dy body are arranged away from each other, melted Dy body does never directly stick to the sintered magnets S having a melted surface of Nd-rich phase when the Dy body commenced its evaporation. The Dy atoms in the Dy vapor atmosphere are supplied and deposited on the surface of sintered magnet S heated to a temperature substantially same as that of Dy body directly from Dy body or from a plurality of directions after repeating collisions and the deposited Dy atoms are diffused into the grain boundary phases of the sintered magnet S and thus the permanent magnet M is manufactured.

As shown in FIG. 3, if Dy atoms in the Dy vapor atmosphere are supplied onto the surface of sintered magnet S and then deposited and recrystallized thereon to form Dy layer (thin film) L1, the surface of permanent magnet M is extremely deteriorated (its surface roughness is worsened). In addition Dy deposited on the surface of sintered magnet S heated to the substantially same temperature during its process is melted and excessively diffuses into grains at a region R1 near the surface of sintered magnet S and thus the magnetic properties cannot be effectively improved or recovered.

That is, if the thin film of Dy is once formed on the surface of sintered magnet S, the average composition in the surface of sintered magnet S becomes Dy-rich and thus the liquid phase temperature is lowered and the surface of sintered magnet S is melted (i.e. the principal phase is melted and the amount of liquid phase is increased). As the result of which a region near the surface of sintered magnet S is melted and damaged and thus its irregularity is increased. Furthermore Dy excessively penetrates into the grains together with a great deal of liquid phase and thus the maximum energy product exhibiting the magnetic properties and the remanent flux density are further worsened.

According to the example of the present invention, Dy body of bulky configuration (substantially spherical configuration) having a small specific surface area (surface area per unit volume) is arranged on the bottom surface of the processing chamber 20 at a rate of 1~10% by weight of the sintered magnet so as to reduce an amount of evaporation under a constant temperature. In addition to that, the temperature in the processing chamber 20 is set at a range of 800° C.~1050° C., preferably 900° C.~1000° C. by controlling the heating means 3 when the metal evaporating material V is Dy (e.g. the saturated vapor pressure of Dy is about $1\times10^{-2}$~$1\times10^{-1}$ Pa when the temperature in the processing chamber is 900° C.~1000° C.).

If the temperature in the processing chamber 20 (accordingly the heating temperature of sintered magnet S) is lower than 800° C., the diffusing velocity of Dy atoms deposited on the surface of sintered magnet S into the grain boundary phases is decreased and thus it is impossible to make the Dy atoms to be diffused and homogeneously penetrated into grain boundary phases of the sintered magnet S before the thin film is formed on the surface of sintered magnet S. On the other hand, if the temperature exceeds 1050° C., the vapor pressure of Dy is increased and thus Dy atoms in the vapor atmosphere are excessively supplied onto the surface of sintered magnet S. In addition, it is afraid that Dy would be diffused into grains and if so, since the magnetization in the grains is greatly reduced, the maximum energy product and the remanent flux density are further reduced.

In order to diffuse Dy into the grain boundary phases before the thin film of Dy is formed on the surface of sintered magnet S, the ratio of a total surface area of the bulky Dy placed on the bottom surface of the processing chamber 20 to a total surface area of the sintered magnet S placed on the bearing grid 21*a* of the processing chamber 20 is set to be a range of $1\times10^{-4}$~$2\times10^{3}$. In a ratio other than the region of $1\times10^{-4}$~$2\times10^{3}$, there would be sometime formed a thin film of Dy and Tb on the surface of sintered magnet S and thus a permanent magnet having high magnetic properties cannot be obtained. In this case, a preferable range of the ratio is $1\times10^{-3}$~$1\times10^{3}$, and more preferable range is $1\times10^{-2}$~$1\times10^{2}$.

This enables the amount of supply of Dy atoms to the sintered magnet S to be suppressed due to the reduction of the vapor pressure as well as the evaporation amount of Dy and also enables the diffusing velocity to be accelerated due to heating of the sintered magnet S in a predetermined range of temperature with making the average grain diameter of sintered magnet S to be included in a predetermined range. Accordingly it is possible to efficiently and homogeneously diffuse and penetrate the Dy atoms deposited on the surface of sintered magnet S into the grain boundary phases of the sintered magnet S before they deposit on the surface of sintered magnet s and form the Dy layer (thin film) (see FIG. 1). As the result of which it is possible to prevent the surface of permanent magnet M from being deteriorated and the Dy atoms from being excessively diffused into grains near the surface of sintered magnet. In addition since the Dy atoms are diffused only in a region near the surface of grains, it is possible to effectively improve and recover the magnetizing properties and coercive force and thus to obtain a permanent magnet M superior in productivity without requiring any finishing work.

When the manufactured sintered magnet is formed to a desired configuration by wire cutting as shown in FIG. 4, the magnetic properties of the sintered magnet would be sometimes extremely deteriorated due to generation of cracks in grains in the principal phase of the surface of sintered magnet (see FIG. 4 (*a*)). However since the Dy-rich phase is formed inside of the cracks of grains near the surface of sintered magnet by performing the vacuum vapor processing (see FIG. 4 (*b*)), the magnetizing properties and coercive force are recovered.

Co has been added in the neodymium magnet of the prior art to prevent corrosion of the magnet. However, according to the present invention, since Dy-rich phase having extremely high corrosion resistance and atmospheric corrosion resistance as compared with Nd exists in the inside of cracks of grains near the surface of the sintered magnet and grain boundary phases, it is possible to obtain a permanent magnet having extremely high corrosion resistance and atmospheric corrosion resistance without using Co. Furthermore since there is not any intermetallic compound including Co in the grain boundary phases of sintered magnet S, the metal atoms of Dy and Tb deposited on the surface of sintered magnet S are further efficiently diffused.

Finally after the process mentioned above have been performed a predetermined period of time (e.g. 4~48 hours), the heating means 3 is deactivated, Ar gas of 10 KPa is introduced into the processing chamber 20 via a gas introducing means (not shown), evaporation of the metal evaporating material V is stopped, and the temperature in the processing chamber 20 is once lowered to 500° C. Continuously the heating means 3 is activated again, the temperature in the processing chamber 20 is set in a range of 450° C.~650° C., and heat treatment is carried out to further improve and recover the magnetizing properties and coercive force. Finally the box 2 is rapidly cooled and taken out from the vacuum chamber 12.

In the example of the present invention, although it has been described that Dy is used as metal evaporating material arranged in the box body 21 together with the sintered magnet S, it is also possible to use Tb having a low vapor pressure in a range of heating temperature (900° C.~1000° C.) of the sintered magnet S enabling to accelerate the optimum diffusing velocity. When the metal evaporating material V arranged in the box body 21 together with the sintered magnet S is Tb, the evaporating chamber may be heated in a range of 900° C.~1150° C. If the temperature is lower than 900° C., the vapor pressure cannot reach to a level enabling to supply the Tb atoms to the surface of sintered magnet S. On the other hand, at a temperature exceeding 1150° C., Tb is excessively diffused into the grains and thus the maximum energy product and the remanent flux density are lowered.

In the example of the present invention, although it has been described that bulky metal evaporating material V having a small specific surface area is used to reduce the amount of evaporation under a constant temperature, this is not absolute. For example, it may be possible to reduce the specific surface area by arranging dish (or dishes) having a recessed cross-section in the box body 21 and placing thereon bulky or granular metal evaporating material V or possible to mount a lid (not shown) having a plurality of openings on the dish after the metal evaporating material V has been placed thereon.

Also in the example of the present invention, although it has been described to arrange the sintered magnet S and the metal evaporate material V in the processing chamber 20, it may be possible for example to provide an evaporating chamber (i.e. other processing chamber, not shown) separately from the processing chamber 20 and other heating means for the evaporating chamber, and to construct so that the metal atoms in the vapor atmosphere are supplied to the sintered magnet in the processing chamber 20 via a connecting passage communicating the processing chamber 20 and the evaporating chamber after the metal evaporating material has been evaporated in the evaporating chamber.

In this case, when the primary component of the metal evaporating material V is Dy, the evaporating chamber may be heated to 700° C.~1050° C. (at this temperature, the saturated vapor pressure may be about $1\times10^{-4}$~$1\times10^{-1}$ Pa). If it is lower than 700° C., the vapor pressure cannot reach a level at which Dy can be supplied to the surface of sintered magnet S so that Dy is diffused and homogeneously penetrated into the grain boundary phases. On the other hand, when the primary component of the metal evaporating material V is Tb, the evaporating chamber may be heated to 900° C.~1200° C. If it is lower than 900° C., the vapor pressure cannot reach a level at which Tb atoms can be supplied to the surface of sintered magnet S. On the contrary if it is higher than 1200° C., Tb would be diffused into grains and thus the maximum energy product and the remanent flux density will be decreased.

When it is possible to heat the sintered magnet S and the metal evaporating material V at different temperatures, it may be possible to heat the sintered magnet S at a temperature in a range of 800° C.~1100° C. and keep it at this temperature. This enables to accelerate the diffusing velocity and thus to efficiently diffuse in order Dy and Tb deposited on the surface of sintered magnet into the grain boundary phases of sintered magnet. If the temperature of sintered magnet lower than 800° C., since it is impossible to have a diffusing velocity enabling Dy and Tb to be diffused and homogeneously penetrated into the grain boundary phases of the surface of sintered magnet, it is afraid that a thin film comprising the metal evaporating material is formed on the surface of sintered magnet. On the other hand, if it is higher than 1100° C., Dy or Tb would be entered into grains being principal phase of the sintered magnet and after all it would be same as that into which Dy or Tb is added during manufacturing the sintered magnet and thus the strength of magnetic field, accordingly the maximum energy product exhibiting the magnetic properties would be extremely reduced.

In order to remove soil, gas or moisture adsorbed on the surface of sintered magnet S before Dy and Tb are diffused into the grain boundary phases, it may be possible to reduce the pressure in the vacuum chamber 12 to a predetermined pressure (e.g. $1\times10^{-5}$ Pa) via the evacuating means 11 and to keep at its pressure for a predetermined period of time after the pressure in the processing chamber 20 has been reduced to a pressure (e.g. $5\times10^{-5}$ Pa) higher substantially by half-digit than the pressure in the vacuum chamber 12. During which it may be possible to heat the processing chamber 20 for example to 100° C. by actuating the heating means 3 and to keep this temperature for a predetermined period of time.

Furthermore it may be possible to provide a known plasma generating apparatus (not shown) for generating Ar or He plasma in the vacuum chamber 12 and to perform a preliminary treatment for cleaning the surface of sintered magnet s by plasma prior to a treatment in the vacuum chamber 12. When the sintered magnet S and the metal evaporating material V are arranged in a same processing chamber 20, it may be possible to arrange a known conveyor robot in the vacuum chamber 12 and to mount the lid 22 in the vacuum chamber 12 after the cleaning has been completed.

Further in the example of the present invention, although it is described that the box 2 is structured by a box body 21 and a lid 22 to be mounted on the top opening of the box body, such a structure is not absolute and any structure can be adapted to the present invention if it is isolated from the vacuum chamber 12 and a pressure in the processing chamber 20 can be reduced in accordance with reduction of pressure in the vacuum chamber 12. For example, it may be possible the top opening of the box body 21 to be covered e.g. by a Mo foil after the sintered magnet S has been contained in the box body 21. It may be also possible to construct the processing chamber 20 is tightly closed in the vacuum chamber 12 so that the processing chamber can keep a predetermined pressure independent of the vacuum chamber 12.

Since the lesser the $O_2$ content, the faster the diffusing velocity of Dy and Tb into the grain boundary phases, $O_2$ content of the sintered magnet S itself may be less than 3000 ppm, preferably 2000 ppm, and more preferably 1000 ppm.

[Embodiment 1]

As a sintered magnet of Nd—Fe—B family, a member machined to a cylinder (10 mm Φ×5 mm) having a composition of 30 Nd-1B-0.1 Cu-2 Co-bal. Fe, $O_2$ content of the sintered magnet S itself of 500 ppm, and average grain diameter: 3 μm was used. In this embodiment, the surface of the sintered magnet S was finished as having the surface roughness of 20 μm or less and then washed by acetone.

Then a permanent magnet M was obtained using the vacuum vapor processing apparatus 1 described above, depositing Dy atoms onto the surface of sintered magnet S in accordance with the method described above, and diffusing the Dy atoms into the grain boundary phases before a thin film of Dy is formed on the surface of sintered magnet S (vacuum vapor processing). In this embodiment, the sintered magnet S was placed on the bearing grid 21*a* in the processing chamber 20, and Dy of 99.9% degree of purity was used as the metal evaporating material. The metal evaporating material has a bulky configuration and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 975° C. The vacuum vapor processing was performed for 12 hours after the temperature in the processing chamber 20 had reached 975° C.

COMPARATIVE EXAMPLE 1

A film-forming processing was performed against the sintered magnet S same as that used in the Embodiment 1 using a vapor deposition apparatus (VFR-200M/ULVAC machinery Co. Ltd.) of a resistor heater type using a Mo board of the prior art. In this Comparative Example 1, an electric current of 150 A was supplied to the Mo board and performed the film-forming process for 30 minutes after Dy of 2 g had been set on the Mo board and the vacuum chamber had been evacuated to $1\times10^{-4}$ Pa.

FIG. 5 is a photograph showing a surface condition of the permanent magnet obtained by performing the processing described above and FIG. 5 (*a*) is a photograph of the sintered magnet S (before process). It is found from this photograph that in the sintered magnet S of "before process" although black portions such as voids of Nd-rich phase being grain boundary phase or de-grain traces can be seen, the black portions disappear when the surface of the sintered magnet is covered by the Dy layer (thin film) as in the Comparative Example 1 (see FIG. 5 (*b*)). In this case the measured value of thickness of the Dy layer (thin film) was 40 μm. On the contrary, it is found in the Embodiment 1 that black portions such as voids of Nd-rich phase or de-grain traces can be seen and thus are substantially same as those of the surface of sintered magnet of "before process". In addition it is found that Dy has been efficiently diffused into the grain boundary phases before formation of the Dy layer because of the fact of weight variation (see FIG. 5 (*c*)).

FIG. 6 is a table showing the magnetic properties of the permanent magnet M obtained in accordance with conditions described above. Magnetic properties of the sintered magnet S "before process" is shown in the table as a comparative example. According to this table it is found that the permanent magnet M of the Embodiment 1 has the maximum energy product (BH)max of 49.9 MGOe, the remanent flux density Br of 14.3 kG, and the coercive force iHc of 23.1 kOe, and thus the coercive force (23.1 kOe) is remarkably improved as compared with that (11.3 kOe) of the sintered magnet S before the vacuum vapor processing.

[Embodiment 2]

As a sintered magnet of Nd—Fe—B family, a member machined to a plate (40×40×5 (thickness) mm) having a composition of 30 Nd-1B-0.1 Cu-2 Co-bal. Fe, $O_2$ content of the sintered magnet S itself of 500 ppm, and average grain diameter of 3 μm was used. In this embodiment, the surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, a Mo box having dimensions of 200×170×60 mm was used as the box 2 and 30 (thirty) sintered magnets S are placed equidistantly apart each other. In addition Dy of 99.9% degree of purity was used as the metal evaporating material. The metal evaporating material has a bulky or granular configuration and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 925° C. The vacuum vapor processing was performed for 12 hours after the temperature in the processing chamber 20 had reached 925° C. Then heat treatment was performed with setting the treating temperature at 530° C. and the treating time period at 90 minutes. Finally the permanent magnet manufactured by performing the method described above was cut by wire-cutting as having a cylindrical configuration of 10 mm Φ×5 mm.

FIG. 7 is a table showing the magnetic properties of permanent magnet when changed the configuration of Dy and the amount of Dy arranged on the bottom surface of the processing chamber so that the ratio of the total surface area of Dy to the total surface area of sintered magnet S in the processing chamber 20. According to this table it is found that Dy can be diffused into the grain boundary phases before the thin film of Dy is formed on the surface of sintered magnet S if bulky Dy of 1~5 mm is used and said ratio is in about $5\times10^{-5}$~1. However it is necessary to make the ratio larger than $1\times10^{-4}$ in order to obtain a high coercive force of about 20 kOe. On the other hand it is found that it is possible to diffuse Dy into the grain boundary phases before the thin film of Dy is formed on the surface of sintered magnet S if said ratio is in about 6~$1\times10^{3}$ although granular Dy of 0.01 mm or 0.4 mm is used and thus to obtain the coercive force higher than 20 kOe. However a thin film of Dy was formed on the surface of sintered magnet S if said ratio becomes larger than $1\times10^{3}$.

[Embodiment 3]

As a sintered magnet of Nd—Fe—B family, a member having a composition of 25 Nd-3 Dy-1B-1 Co-0.2 Al-0.1 Cu-bal. Fe was used and this member was machined to a rectangular parallelopiped of 2×20×40 mm. In this embodiment, an alloy of 0.05 mm~0.5 mm was made by a known strip casting method with formulating Fe, B, Nd, Dy, Co, Al, Cu at said composition ratio and then once ground by a known hydrogen grinding process and continuously pulverized by the jet milling process. Then a sintered magnet S having the average grain diameter of 0.5 μm~25 μm was obtained by sintering the pulverized powder under predetermined conditions after having been magnetic field oriented and formed to a predetermined configuration in a mold. The surface of the sintered magnet S was finished as having the surface roughness of 50 μm or less and then washed by acetone.

Then a permanent magnet M was obtained using the vacuum vapor processing apparatus 1 and the vacuum vapor processing method described above. In this embodiment, 100 (one hundred) sintered magnets S are placed on the bearing grid 21*a* in the Mo box 2 equidistantly apart each other. In addition bulky Dy of 99.9% degree of purity was used as the metal evaporating material and the total weight of 10 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 975° C. The vacuum vapor processing was performed for 1~72 hours after the temperature in the processing chamber 20 had reached 975° C. Then heat treatment was performed with setting the treating temperature at 500° C. and the treating time period at 90 minutes.

FIG. 8 is a table showing the magnetic properties of the permanent magnet obtained in accordance with conditions described above at average values. According to this table it is found that a permanent magnet having the maximum energy product (BH)max of 52 MGOe or more, the remanent flux density Br of 14.3 kG or more, and the coercive force iHc of 30 kOe or more when the average grain diameter is 1~5 μm or 7~20 μm.

[Embodiment 4]

As a sintered magnet of Fe—B—Nd family not including Co, a member having a composition of 27 Nd-1 B-0.05 Cu-0.05 Ga-0.1 Zr-bal. Fe was used. In this embodiment, an alloy of 0.05 mm~0.5 mm was made by a known strip casting method with formulating Fe, B, Nd, Gu, Ga, Zr at said composition ratio and then once ground by a known hydrogen grinding process and continuously pulverized by the jet milling process. Then a sintered magnet of a rectangular parallelopiped of 3×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S are placed on the bearing grid 21*a* in the Mo box 2 equidistantly apart each other. In addition bulky Dy of 99.9% degree of purity was used as the metal evaporating material and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 900° C. Then after the temperature in the processing chamber 20 had reached 900° C., the vacuum vapor processing was performed for 2~38 hours at every 4 hour interval. Then heat treatment was performed with setting the treating temperature at 500° C. and the treating time period at 90 minutes and searched for the vacuum vapor processing hour (time interval) obtainable best magnetic properties (optimum vacuum vapor processing hour).

COMPARATIVE EXAMPLE 4

In Comparative Examples 4a~4c, sintered magnets each having a composition of 27 Nd-1 Co-1 B-0.05 Cu-0.05 Ga-0.1 Zr-bal. Fe (Comparative Example 4a), 27 Nd-4 Co-1 B-0.05 Cu-0.05 Ga-0.1 Zr-bal. Fe (Comparative Example 4b), and 27 Nd-8 Co-1 B-0.05 Cu-0.05 Ga-0.1 Zr-bal. Fe (Comparative Example 4c) were used as a sintered magnet of Fe—B—Nd family including Co. In these examples, an alloy of 0.05 mm-0.5 mm was made by a known strip casting method with formulating Fe, B, Nd, Co, Gu, Ga, Zr at said composition ratio and then once ground by a known hydrogen grinding process and continuously pulverized by the jet milling process. Then a sintered magnet of a rectangular parallelopiped of 3×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone. Then permanent magnets of the Comparative Examples 4a~4c was obtained by performing the processing described above under same conditions as those of the Embodiment 4 and searched for the optimum vacuum vapor processing hour.

FIG. 9 is a table showing the average values of the magnetic properties of permanent magnets obtained in the Embodiment 4 and Comparative Examples 4a~4c as well as evaluation of the corrosion resistance. Magnetic properties before the vacuum vapor processing of the present invention was performed are also shown in the table (FIG. 9). The 100 hour saturated vapor pressurizing test (Pressure Cooker Test: PCT) was carried out for the corrosion resistance test.

According to this table (FIG. 9), it is found that since the permanent magnets the Comparative Examples 4a~4c include Co, generation of corrosion is not visible in the test despite of performing the vacuum vapor processing of the present invention. However, although they have high corrosion resistance, it is impossible to have a high coercive force when the time interval of the vacuum vapor processing is short and the optimum vapor processing time interval (hour) will be extended in accordance with increase of Co content in the composition.

On the contrary, in the permanent magnet of the Embodiment 4, it is found that no corrosion is visible after the test despite of including no Co and thus it has high corrosive resistance. Furthermore it is found that the permanent magnet of the Embodiment 4 can provide high coercive force of average 18 kOe after a very short vacuum vapor processing such as 2 hours.

[Embodiment 5]

As a sintered magnet of Nd—Fe—B family, a member having a composition of 20 Nd-5 Pr-3 Dy-1B-1 Co-0.2 Al-bal. Fe was used. This member had its own $O_2$ content of 3000 ppm and average grain diameter of 4 μm and was machined to a plate of 20×40×2 (thickness) mm. In this embodiment, an alloy of 5 mm (thickness) was made by a known centrifugal casting method with formulating Fe, B, Nd, Dy, Co, Al, Pr at said composition ratio and then once ground by a known hydrogen grinding process and continuously pulverized by the jet milling process. Then a sintered magnet S was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S are placed on the bearing grid 21*a* in the box 2 equidistantly apart each other. In addition bulky Dy of 99.9% degree of purity was used as the metal evaporating material and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) and then the pressure in the processing chamber was set at $1\times10^{-2}$ Pa. After the temperature in the processing chamber 20 reached a predetermined temperature, the process described above was performed for 12 hours. In this Embodiment 5, the sintered magnet S and the metal vapor material V were heated to a substantially same temperature. Then heat treatment was performed with setting the treating temperature at 500° C. and the treating time period at 90 minutes.

FIG. 10 is a table showing average values of magnetic properties of permanent magnets when the temperature in the processing chamber 20 was varied in a range of 750° C.~1100° C. together with average values of sintered magnet when the vacuum vapor processing was not carried out. According to this table it is found that sufficient Dy atoms cannot be supplied to the surface of the sintered magnet S at a temperature lower than 800° C. and thus the coercive force iHc cannot be effectively improved. On the other hand, the maximum energy product (BH)max and the remanent flux density Br were reduced because of excessive supply of the Dy atoms at a temperature exceeding 1050° C. In this case the surface of the sintered magnet was formed with Dy layer.

On the contrary, it is found that a permanent magnet of high magnetic properties having the maximum energy product (BH)max of more than 50 MGOe, the remanent flux density Br of more than 14.3 kG and the coercive force iHc more than 22 kOe was obtained when the temperature of the processing chamber 20 were set at a range of 800° C.~1050° C. In this case since Dy layer was not formed on the surface of sintered magnet and there was weight variation, it is found that Dy has been efficiently diffused into the grain boundary phases before the Dy layer is formed.

[Embodiment 6]

As a sintered magnet of Nd—Fe—B family, a member having a composition of 20 Nd-8 Pr-3 Dy-1B-1 Co-0.2 Al-bal. Fe was used. This member had its own $O_2$ content of 3000 ppm and average grain diameter of 4 μm and was machined to a plate of 20×40×2 (thickness) mm. In this embodiment, an alloy of 10 mm (thickness) was made by a known centrifugal casting method with formulating Fe, B, Nd, Dy, Co, Al, Pr at said composition ratio and then once ground by a known hydrogen grinding process and continuously pulverized by the jet milling process. Then a sintered magnet S was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S are placed on the bearing grid 21*a* in the box 2 equidistantly apart each other. In addition bulky Dy of 99.9% degree of purity was used as the metal evaporating material and the total weight of 1 g of the metal evaporating material was placed on the bottom surface of the processing chamber 20.

Then the pressure in the processing chamber 20 was set at $1\times10^{-4}$ Pa. After the temperature in the processing chamber 20 reached a predetermined temperature, the process described above was performed for 12 hours. In this Embodiment 5, the sintered magnet S and the metal vapor material V were heated to a substantially same temperature. Then heat treatment was performed with setting the treating temperature at 600° C. and the treating time period at 90 minutes.

FIG. 11 is a table showing average values of magnetic properties of permanent magnets when the temperature in the processing chamber 20 was varied in a range of 850° C.~1200° C. together with average values of sintered magnet when the vacuum vapor processing was not carried out. According to this table it is found that sufficient Dy atoms cannot be supplied to the surface of the sintered magnet S at a temperature lower than 900° C. and thus the coercive force iHc cannot be effectively improved. On the other hand, the maximum energy product (BH)max, the remanent flux density Br, and also the coercive force iHc were reduced because of excessive supply of the Dy atoms at a temperature exceeding 1150° C. In this case the surface of the sintered magnet was formed with Tb layer.

On the contrary, it is found that a permanent magnet of high magnetic properties having the maximum energy product (BH)max of more than 50 MGOe, the remanent flux density Br of more than 14.6 kG and the coercive force iHc more than 21 kOe (or 30 kOe according to conditions) could be obtained when the temperature of the processing chamber 20 were set at a range of 900° C.~1150° C. In this case since Tb layer was not formed on the surface of sintered magnet.

[Embodiment 7]

As a sintered magnet of Nd—Fe—B family, a member having a composition of 25 Nd-3 Dy-1B-1 Co-0.2 Al-0.1 Cu-bal. Fe was used and machined to a rectangular parallelopiped of 2×20×40 mm. In this embodiment, an alloy of 0.05~0.5 mm was made by a known strip casting method with formulating Fe, B, Nd, Dy, Co, Al, Cu at said composition ratio and then once ground by a known hydrogen grinding process and continuously pulverized by the jet milling process. Then a sintered magnet S was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 100 (one hundred) sintered magnets S are placed on the bearing grid 21*a* in the Mo box 2 equidistantly apart each other. In addition bulky Dy of 99.9% degree of purity was used as the metal evaporating material and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 975° C. Then after the temperature in the processing chamber 20 had reached 975° C., the vacuum vapor processing was performed for 1~72 hours. Then heat treatment was performed with setting the treating temperature at 500° C. and the treating time period at 90 minutes.

FIG. 12 is a table showing the magnetic properties of the permanent magnet obtained in accordance with conditions described above at average values. According to this table it is found that a permanent magnet having the maximum energy product (BH)max of 50 MGOe or more, the remanent flux density Br of 14.3 kG or more, and the coercive force iHc of 30 kOe or more (or 36 kOe according to conditions) could be obtained when the average grain diameter is 1~5 μm or 7~20 μm.

[Embodiment 8]

As a sintered magnet of Fe—B—Nd family not including Co, a member having a composition of 28 Nd-1 B-0.05 Cu-0.05 Ga-0.1 Zr-bal. Fe was used. In this embodiment, an alloy of 0.05 mm~0.5 mm was made by a known strip casting method with formulating Fe, B, Nd, Gu, Ga, Zr at said composition ratio and then once ground by a known hydrogen grinding process and continuously pulverized by the jet milling process. Then a sintered magnet of a rectangular parallelopiped of 3×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S are placed on the bearing grid 21*a* in the Mo box 2 equidistantly apart each other. In addition bulky Dy of 99.9% degree of purity was used as the metal evaporating material and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 900° C. Then after the temperature in the processing chamber 20 had reached 900° C., the vacuum vapor processing was performed for 2~38 hours at every 4 hour interval. Then heat treatment was performed with setting the treating temperature at 500° C. and the treating time period at 90 minutes and searched for the vacuum vapor processing hour (time interval) obtainable best magnetic properties (optimum vacuum vapor processing hour).

COMPARATIVE EXAMPLE 8

In Comparative Examples 8a~8c, sintered magnets each having a composition of 28 Nd-1 Co-1 B-0.05 Cu-0.05 Ga-0.1 Zr-bal. Fe (Comparative Example 8a), 28 Nd-4 Co-1 B-0.05 Cu-0.05 Ga-0.1 Zr-bal. Fe (Comparative Example 8b), and 28 Nd-8 Co-1 B-0.05 Cu-0.05 Ga-0.1 Zr-bal. Fe (Comparative Example 8c) were used as a sintered magnet of Fe—B—Nd family including Co. In these examples, an alloy of 0.05 mm~0.5 mm was made by a known strip casting method with formulating Fe, B, Nd, Co, Gu, Ga, Zr at said composition ratio and then once ground by a known hydrogen grinding process and continuously pulverized by the jet milling process. Then a sintered magnet of a rectangular parallelopiped of 3×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone. Then permanent magnets of the Comparative Examples 8a~8c was obtained by performing the processing described above under same conditions as those of the Embodiment 8 and searched for the optimum vacuum vapor processing hour.

FIG. 13 is a table showing the average values of the magnetic properties of permanent magnets obtained in the Embodiment 8 and Comparative Examples 8a~8c as well as evaluation of the corrosion resistance. Magnetic properties before the vacuum vapor processing of the present invention was performed are also shown in the table (FIG. 13). The 100 hour saturated vapor pressurizing test (Pressure Cooker Test: PCT) was carried out for the corrosion resistance test.

According to this table (FIG. 13), it is found that since the permanent magnets the Comparative Examples 8a~8c include Co, generation of corrosion is not visible in the test despite of performing the vacuum vapor processing of the present invention. However, although they have high corrosion resistance, it is impossible to have a high coercive force when the time interval of the vacuum vapor processing is short and the optimum vapor processing time interval (hour) will be extended in accordance with increase of Co content in the composition.

On the contrary, in the permanent magnet of the Embodiment 8, it is found that no corrosion is not visible after the test despite of including no Co and thus it has high corrosive resistance. Furthermore it is found that the permanent magnet can provide high coercive force of average 18 kOe after a very short vacuum vapor processing such as 2 hours.

[Embodiment 9]

As a sintered magnet of Nd—Fe—B family, a member machined to a sheet (20×40×1 (thickness) mm) having a composition of 20 Nd-5 Pr-3 Dy-1 B-1 Co-0.2 Al-0.1 Cu-bal. Fe and average grain diameter of 7 μm was used. In this embodiment, the surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S was placed on the bearing grid 21*a* in the Mo box 2 equidistantly apart each other. The temperature of the sintered magnet itself can be varied by heating or cooling the bearing grid 21*a*. In addition Dy of 99.9% degree of purity was used as the metal evaporating material V. The metal evaporating material has a granular configuration of 2 mm Φ and the total weight of 5 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at predetermined temperatures (750, 800, 850, 900° C.) and the vacuum vapor processing was performed for 12 hours after the temperature in the processing chamber 20 had reached a predetermined temperature.

FIG. 14 is a table showing average values of magnetic properties of permanent magnets when the permanent magnet is obtained under the predetermined temperature of the processing chamber 20 (accordingly the metal evaporating material V) with varying the temperature of sintered magnet. According to this table it is found that a high coercive force iHc cannot be obtained if the temperature of the sintered magnet is lower than 800° C. when the temperature in the processing chamber is 750~900° C. and on the other hand, if the temperature of the sintered magnet is higher than 1100° C., not only the coercive force iHc but the maximum energy product (BH)max and the remanent flux density Br are also reduced. On the contrary, it is found that a permanent magnet of high magnetic properties having the maximum energy product (BH)max of more than 48 MGOe, the remanent flux density Br of more than 14 kG and the coercive force iHc more than 21 kOe (or 27 kOe according to conditions) could be obtained at a range of 800° C.~1100° C.

[Embodiment 10]

As a sintered magnet of Nd—Fe—B family, a member having a composition of 25 Nd-2 Dy-1 B-1 Co-0.2 Al-0.05 Cu-0.1 Nb-0.1 Mo-bal. Fe was used and machined to a rectangular parallelopiped of 20×20×40 mm. In this embodiment, an ingot was made by a known centrifugal casting method with formulating Fe, B, Nd, Dy, Co, Al, Cu, Nb, Mo at said composition ratio and then once ground by a known hydrogen grinding process and continuously pulverized by the jet milling process. Then a sintered magnet S having average grain diameter of 0.5 μm~25 μm was obtained by sintering the pulverized powder under predetermined conditions after having been magnetic field oriented and formed to a predetermined configuration in a mold. The $O_2$ content of the sintered magnet S was 50 ppm. The surface of the sintered magnet S was finished as having the surface roughness of 50 μm or less and then washed by acetone.

Then a permanent magnet M was obtained using the vacuum vapor processing apparatus 1 and the vacuum vapor processing method described above. In this embodiment, 100 (one hundred) sintered magnets S are placed on the bearing grid 21*a* in the Mo box 2 equidistantly apart each other. In addition an alloy of 50 Dy and 50 Tb was used as the metal evaporating material and granular metal evaporating material of 2 mm Φ of the total weight of 5 g was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 975° C. Then after the temperature in the processing chamber 20 had reached 975° C., the vacuum vapor processing was performed for 1~72 hours. Then heat treatment was performed with setting the treating temperature at 400° C. and the treating time period at 90 minutes.

FIG. 15 is a table showing the magnetic properties of the permanent magnet obtained in accordance with conditions described above at average values. According to this table it is found that a permanent magnet having the maximum energy product (BH)max of 51.5 MGOe or more, the remanent flux density Br of 14.4 kG or more, and the coercive force iHc of 28 kOe or more could be obtained when the average grain diameter is 1~5 μm or 7~20 μm.

[Embodiment 11]

As a sintered magnet of Fe—B—Nd family not including Co, a member having a composition of 21 Nd-7 Pr-1 B-0.05 Cu-0.05 Ga-0.1 Zr-bal. Fe was used. In this embodiment, an alloy of 0.05 mm~0.5 mm was made by a known strip casting method with formulating Fe, B, Nd, Gu, Ga, Zr, Pr at said composition ratio and then once ground by a known hydrogen grinding process and continuously pulverized by the jet milling process. Then a sintered magnet of a rectangular parallelopiped of 5×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone.

Then a permanent magnet M was obtained using the vacuum vapor processing apparatus 1 and the vacuum vapor processing method described above. In this embodiment, 10 (ten) sintered magnets S are placed on the bearing grid 21*a* in the Mo box 2 equidistantly apart each other. In addition bulky Dy of 99.9% degree of purity was used as the metal evaporating material and the total weight of 1 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 950° C. Then after the temperature in the processing chamber 20 had reached 950° C., the vacuum vapor processing was performed for 2~38 hours at every 2 hour interval. Then heat treatment was performed with setting the treating temperature at 650° C. and the treating time period at 2 hours and searched for the vacuum vapor processing hour (time interval) obtainable best magnetic properties (optimum vacuum vapor processing hour).

COMPARATIVE EXAMPLE 11

In Comparative Examples 11a~11c, sintered magnets each having a composition of 21 Nd-7 Pr-1 Co-1 B-0.05 Cu-0.05 Ga-0.1 Zr-bal. Fe (Comparative Example 11a), 21 Nd-7 Pr-4 Co-1 B-0.05 Cu-0.05 Ga-0.1 Zr-bal. Fe (Comparative Example 11b), and 21 Nd-7 Pr-8 Co-1 B-0.05 Cu-0.05 Ga-0.1 Zr-bal. Fe (Comparative Example 11c) were used as a sintered magnet of Fe—B—Nd family including Co. In these examples, an alloy of 0.05 mm-0.5 mm was made by a known strip casting method with formulating Fe, B, Nd, Co, Gu, Ga, Zr, Pr at said composition ratio and then once ground by a known hydrogen grinding process and continuously pulverized by the jet milling process. Then a sintered magnet of a rectangular parallelopiped of 5×20×40 mm was obtained by sintering the pulverized powder under predetermined conditions after having been magnetic field oriented and formed to a predetermined configuration in a mold. The surface of the sintered magnet S was finished as having the surface roughness of 20 μm or less and then washed by acetone. Then permanent magnets of the Comparative Examples 11a~11c was obtained by performing the processing described above under same conditions as those of the Embodiment 11 and searched for the optimum vacuum vapor processing hour.

FIG. 16 is a table showing the average values of the magnetic properties of permanent magnets obtained in the Embodiment 11 and Comparative Examples 11a~11c as well as evaluation of the corrosion resistance. Magnetic properties before the vacuum vapor processing of the present invention was performed are also shown in the table (FIG. 16). The saturated vapor pressurizing test (Pressure Cooker Test: PCT) was carried out as the corrosion resistance test for a predetermined period of time.

According to this table (FIG. 16), it is found that since the permanent magnets the Comparative Examples 11a~11c include Co, generation of corrosion is not visible in the test despite of performing the vacuum vapor processing of the present invention. However, although they have high corrosion resistance, it is impossible to have a high coercive force when the time interval of the vacuum vapor processing is short and the optimum vapor processing time interval (hour) will be extended in accordance with increase of Co content in the composition.

On the contrary, in the permanent magnet of the Embodiment 11, it is found that no corrosion is not visible after the test despite of including no Co and thus it has high corrosive resistance. Furthermore it is found that the permanent magnet can provide high coercive force of average 20.5 kOe after a very short vacuum vapor processing such as 4 hours.

[Embodiment 12]

As a sintered magnet of Nd—Fe—B family, a member having a composition of 20 Nd-7 Pr-1 B-1-0.2 Al-0.05 Ga-0.1 Zr-0.1 Sn-bal. Fe was used and machined to a rectangular parallelopiped of 20×20×40 mm. In this embodiment, an ingot was made by a known centrifugal casting method with formulating Fe, B, Nd, Pr, Al, Ga, Zr, Sn at said composition ratio and then once ground by a known hydrogen grinding process and continuously pulverized by the jet milling process. Then a sintered magnet S having average grain diameter of 5 μm was obtained by sintering the pulverized powder under predetermined conditions after having been magnetic field oriented and formed to a predetermined configuration in a mold. Two samples of the sintered magnets were made one of which is that obtained with being rapidly cooled after sintering (Sample 1) and the other is that heat treated for 2 hours in a range of 400° C.~700° C. after sintering (Sample 2). The surfaces of these samples were finished as having the surface roughness of 20 μm or less and then washed by acetone.

Then a permanent magnet M was obtained using the vacuum vapor processing apparatus 1 and the vacuum vapor processing method described above. In this embodiment, 100 (one hundred) sintered magnets S are placed on the bearing grid 21*a* in the Mo box 2 equidistantly apart each other. In addition Dy of 99.9% degree of purity was used as the metal evaporating material V. The metal evaporating material has a granular configuration of 5 mm Φ and the total weight of 20 g of the metal evaporating material was placed on the bottom surface of the processing chamber 20.

Then the vacuum chamber was once reduced to $1\times10^{-4}$ Pa (the pressure in the processing chamber was $5\times10^{-3}$ Pa) with activating the evacuating means and the temperature of the processing chamber 20 heated by the heating means 3 was set at 900° C. Then after the temperature in the processing chamber 20 had reached a predetermined temperature, the vacuum vapor processing was performed for 6 hours. Then heat treatment was performed with setting a treatment temperature at a predetermined value and the treating time period at 2 hours.

FIG. 17 is a table showing average values of magnetic properties of permanent magnets when the permanent magnet is obtained with the temperature of heat treatment after the vacuum vapor processing being varied in a range of 400° C.~700° C. In the Sample 1 not heat-treated after sintering, the coercive force iHc was small (5.2 kOe) and it was impossible to obtain a permanent magnet having a high coercive force iHc even though the Sample 1 was heat treated after the vacuum vapor processing. On the contrary, in the Sample 2 heat-treated after sintering, it is found that it was possible to manufacture a permanent magnet having a large coercive force iHc (18 kOe) (26.5 kOe according to conditions) when the Sample 2 was heat-treated after the vacuum vapor processing although its coercive force iHc is small (12.1 kOe) before the vacuum vapor processing.

[Embodiment 13]

As a sintered magnet of Nd—Fe—B family, it was used a member having a composition of 21 Nd-7 Pr-1 B-0.2 Al-0.05 Ga-0.1 Zr-0.1 Mo-bal. Fe and the average grain diameter of 10 μm and machined to a rectangular parallelopiped of 20×20×40 mm.

Then a permanent magnet M was obtained using the vacuum vapor processing apparatus 1 and the vacuum vapor processing method described above. In this embodiment, 100 (one hundred) sintered magnets S are placed on the bearing grid 21*a* in the Mo box 2 equidistantly apart each other. In addition Dy of 99.9% degree of purity was used as the metal evaporating material V. The metal evaporating material has a granular configuration of 10 mm Φ and the total weight of 20 g of the metal evaporating material was placed on the bottom surface of the processing chamber 20.

Then the vacuum chamber was once reduced to a predetermined degree of vacuum (the pressure in the processing chamber became substantially higher than the vacuum by half-digit) with activating the evacuating means and the temperature of the processing chamber 20 heated by the heating means 3 was set at 900° C. Then after the temperature in the processing chamber 20 had reached 900° C., the vacuum vapor processing was performed for 6 hours. Then heat treatment was performed with setting a treatment temperature at 550° C. and the treating time period at 2 hours.

FIG. 18 is a table showing average values of magnetic properties of permanent magnets when the permanent magnet is obtained with the pressure in the vacuum chamber 11 being varied by adjusting the opening of the evacuating valve and an amount of Ar introduction into the vacuum chamber. According to this table (FIG. 18), it is found that a permanent magnet having the maximum energy product (BH)max of 53.1 MGOe or more, the remanent flux density Br of 14.8 kG or more, and the coercive force iHc of 18 kOe or more could be obtained when the pressure in the vacuum chamber 11 is 1 Pa or less.

[Embodiment 14]

As a sintered magnet of Nd—Fe—B family, it was used a member having a composition of 20 Nd-5 Pr-3 Dy-1 B-1 Co-0.1 Al-0.03 Ga-bal. Fe and the average grain diameter of 0.5~25 μm and machined to a rectangular parallelopiped of 20×20×40 mm. The surface of the sintered magnet S was finished as having the surface roughness of 20 μm or less and then washed by acetone.

Then a permanent magnet M was obtained using the vacuum vapor processing apparatus (not shown) separately provided with a evaporating chamber communicating with the processing chamber 20 via a communicating passage and another heating means heating the evaporating chamber and the vacuum vapor processing method described above. In this embodiment, 10 (ten) sintered magnets S are placed on the bearing grid 21*a* in the Mo box 2 equidistantly apart each other. In addition Dy of 99.9% degree of purity was used as the metal evaporating material V. The metal evaporating material has a granular configuration of 1 mm Φ and the total weight of 10 g of the metal evaporating material was placed on the bottom surface of the evaporating chamber having same configuration of the Mo box 2.

Then the vacuum chamber was once reduced to $1\times10^{-4}$ Pa (the pressure in the processing chamber and the evaporating chamber was $1\times10^{-3}$ Pa) with activating the evacuating means Dy was evaporated with setting the temperature of the processing chamber 20 (accordingly the temperature of sintered magnet) heated by the heating means 3 at a predetermined temperature (750, 800, 900, 1000, 1100, 1150° C.), and setting the temperature of the evaporated chamber at a predetermined temperature by the other heating means. The processing described above was performed under these conditions with introducing the Dy atoms onto the surface of sintered magnet S via the communicating passage. Then heat treatment was performed with setting a treatment temperature at 600° C. and the treating time period at 90 minutes.

FIG. 19 is a table showing average values of magnetic properties of permanent magnets when the permanent magnet is obtained under the predetermined temperature of the processing chamber 20 (accordingly the sintered magnet) with varying the heating temperature of the evaporating chamber. According to this table (FIG. 19) it is found that a permanent magnet having the maximum energy product (BH)max of 47.8 MGOe or more, the remanent flux density Br of 14 kG or more, and the coercive force iHc of 15.9 kOe or more (or 27 kOe according to conditions) could be obtained if Dy is evaporated by heating the evaporating chamber at 800° C.~1200° C. when the temperature of the sintered magnet is in a range of 800° C.~1100° C.

[Embodiment 15]

BRIEF DESCRIPTION OF DRAWINGS

FIG. 6 is a table showing the magnetic properties of a permanent magnet manufactured in accordance with Embodiment 1 of the present invention;

FIG. 7 is a table showing the magnetic properties of a permanent magnet manufactured in accordance with Embodiment 2 of the present invention;

FIG. 8 is a table showing the magnetic properties of a permanent magnet manufactured in accordance with Embodiment 3 of the present invention;

FIG. 9 is a table showing the magnetic properties of a permanent magnet manufactured in accordance with Embodiment 4 of the present invention;

FIG. 10 is a table showing the magnetic properties of a permanent magnet manufactured in accordance with Embodiment 5 of the present invention;

FIG. 11 is a table showing the magnetic properties of a permanent magnet manufactured in accordance with Embodiment 6 of the present invention;

FIG. 12 is a table showing the magnetic properties of a permanent magnet manufactured in accordance with Embodiment 7 of the present invention;

FIG. 13 is a table showing the magnetic properties of a permanent magnet manufactured in accordance with Embodiment 8 of the present invention;

FIG. 14 is a table showing the magnetic properties of a permanent magnet manufactured in accordance with Embodiment 9 of the present invention;

FIG. 15 is a table showing the magnetic properties of a permanent magnet manufactured in accordance with Embodiment 10 of the present invention;

FIG. 16 is a table showing the magnetic properties of a permanent magnet manufactured in accordance with Embodiment 11 of the present invention;

FIG. 17 is a table showing the magnetic properties of a permanent magnet manufactured in accordance with Embodiment 12 of the present invention;

FIG. 18 is a table showing the magnetic properties of a permanent magnet manufactured in accordance with Embodiment 13 of the present invention; and FIG. 19 is a table showing the magnetic properties of a permanent magnet manufactured in accordance with Embodiment 14 of the present invention.

DESCRIPTION OF REFERENCE NUMERALS AND CHARACTERS

Figure 1:
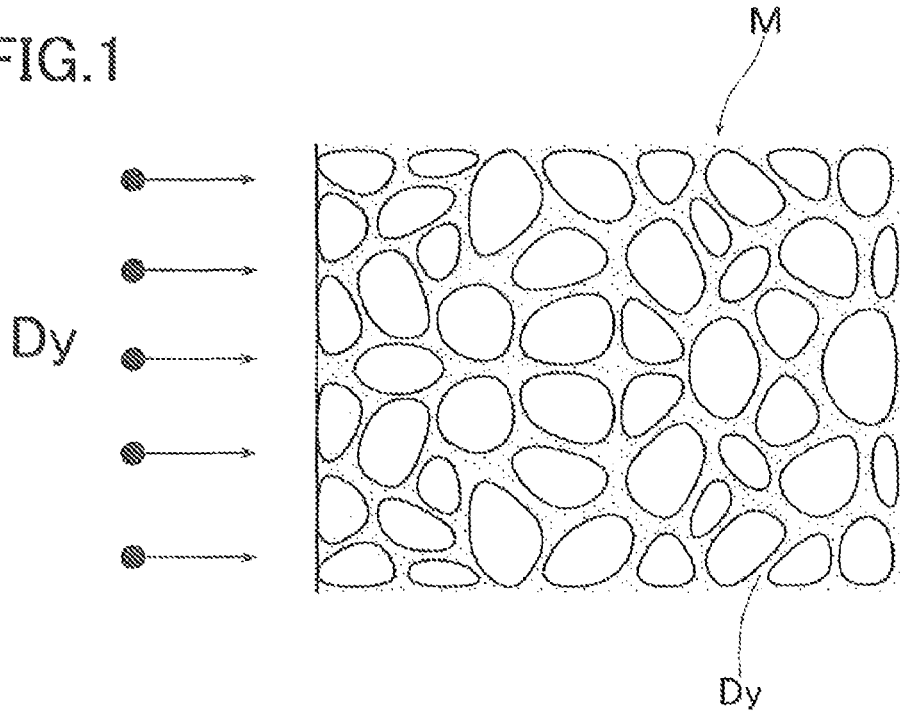
FIG. 1 is a schematic explanatory view of a cross-section of the permanent magnet manufactured in accordance with the present invention.
Figure 2:
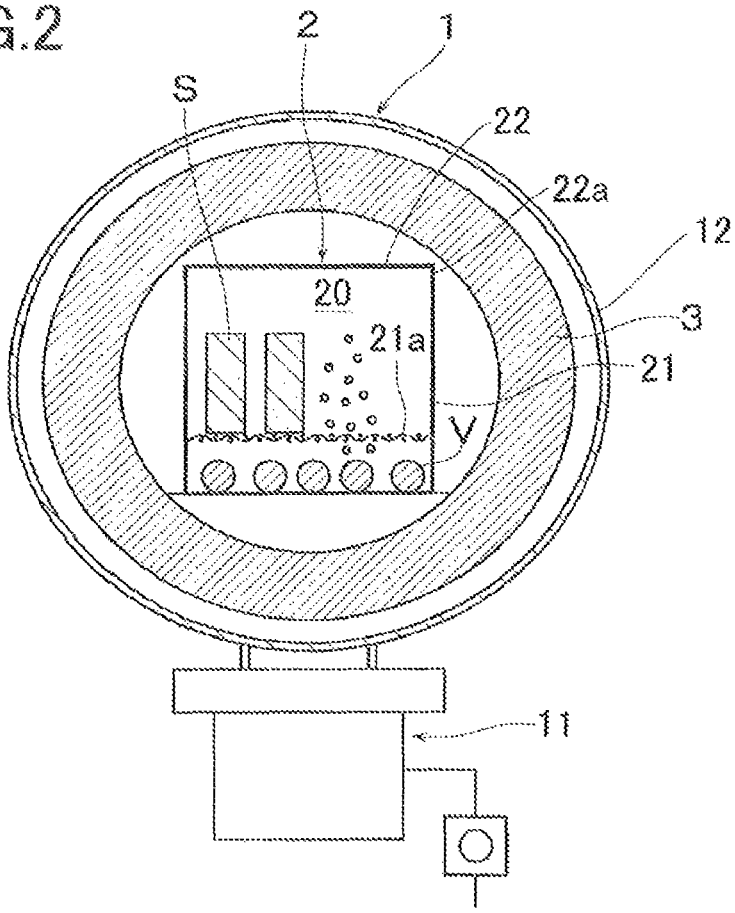
FIG. 2 is a schematic view of the vacuum processing apparatus for performing the processing method of the present invention.
Figure 3:
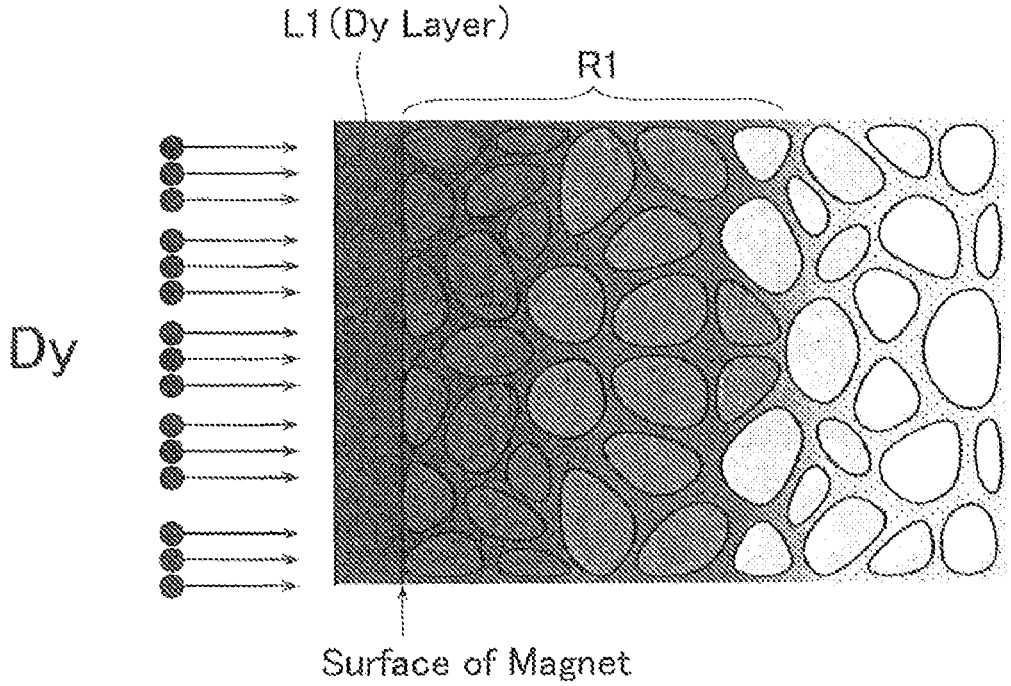
FIG. 3 is a schematic explanatory view of a cross-section of a permanent magnet manufactured in accordance with a prior art.
Figure 4:
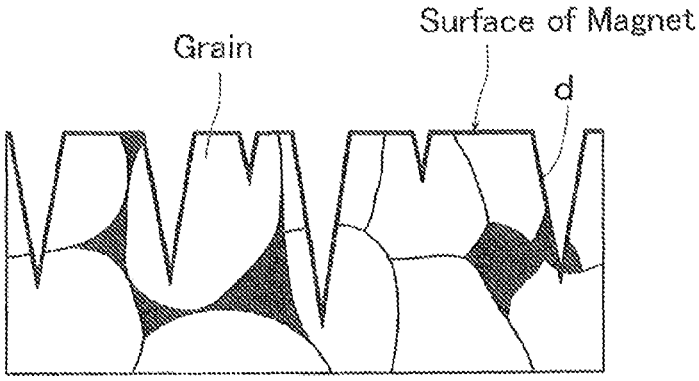
FIG. 4 (*a*) is an explanatory view showing defects on the surface of sintered magnet caused by machining, and FIG. 4 (*b*) is an explanatory view showing a surface condition of sintered magnet manufactured in accordance with the present invention.
Figure 4:
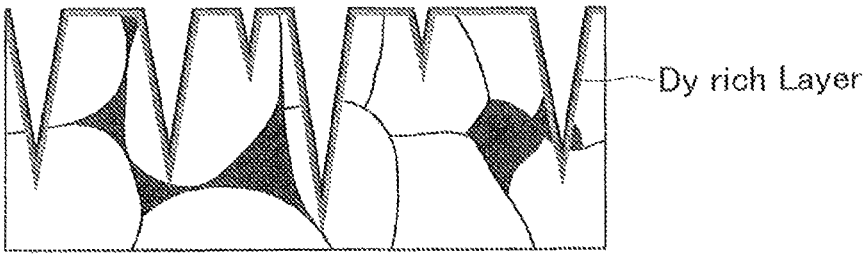
Figure 5:
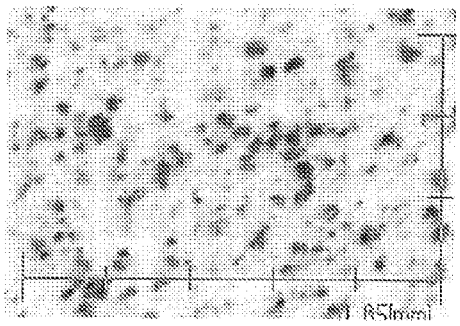
FIGS. 5 (*a*), (*b*) and (*c*) are photographs each showing an enlarged surface of a permanent magnet manufactured in accordance with the present invention.
Figure 5:
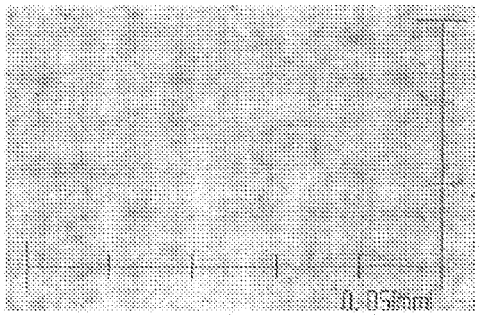
Figure 5:
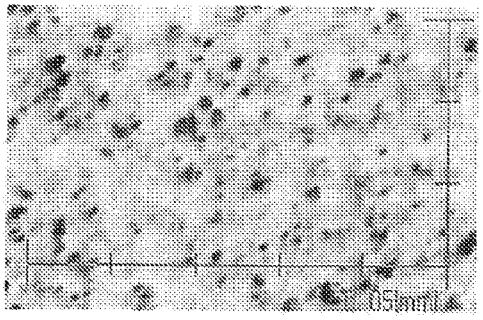

1 vacuum vapor processing apparatus
12 vacuum chamber
2 processing chamber
3 heating means
S sintered magnet
M permanent magnet
V metal evaporating material

What is claimed is:

1. Method for manufacturing a permanent magnet comprising steps of heating a sintered magnet of Fe—B-rare earth elements family arranged in a processing chamber to a predetermined temperature;

evaporating a metal evaporating material including at least one of Dy and Tb arranged in said processing chamber or another processing chamber;

depositing evaporated metal atoms from the metal evaporating material onto a surface of the sintered magnet with controlling a supplying amount of the metal atoms; and diffusing the deposited metal atoms into grain boundary phases of the sintered magnet, wherein the depositing and the diffusing are performed without formation of a thin film of the metal evaporating material on the surface of the sintered magnet.

2. Method for manufacturing a permanent magnet of claim 1 wherein said processing chamber is heated to a temperature in a range of 800° C.~1050° C. under a vacuum condition when the sintered magnet of Fe—B-rare earth elements family and the metal evaporating material having a primary component of Dy are arranged in the processing chamber.

3. Method for manufacturing a permanent magnet of claim 1 wherein said processing chamber is heated to a temperature in a range of 900° C.~1150° C. under a vacuum condition when the sintered magnet of Fe—B-rare earth elements family and the metal evaporating material having a primary component of Tb are arranged in the processing chamber.

4. Method for manufacturing a permanent magnet of claim 1, further comprising steps of:

arranging the sintered magnet of Fe—B-rare earth elements family in the processing chamber and heating the sintered magnet to a temperature in a range of 800° C.~1100° C.;

heating and evaporating the metal evaporating material including at least one of Dy and Tb arranged in said processing chamber or another processing chamber; and supplying and depositing the evaporated metal atoms onto the surface of the sintered magnet.

5. Method for manufacturing a permanent magnet of claim 1 further comprising steps of:

arranging the sintered magnet of Fe—B-rare earth elements family in the processing chamber;

heating and evaporating the metal evaporating material including at least one of Dy and Tb arranged in said processing chamber or another processing chamber to a temperature in a range of 800° C.~1200° C. after heating and holding the sintered magnet to a predetermined temperature; and supplying and depositing the evaporated metal atoms onto the surface of the sintered magnet.

6. Method for manufacturing a permanent magnet of claim 1 wherein the sintered magnet and the metal evaporating material are arranged apart from each other when the sintered magnet and the metal evaporating material are arranged in the same processing chamber.

7. Method for manufacturing a permanent magnet of claim 1 wherein a ratio of a total surface area of the metal evaporating material to a total surface area of the sintered magnet arranged in the processing chamber is set in a range of $1\times10^{-4}$~$2\times10^{3}$.

8. Method for manufacturing a permanent magnet of claim 1 wherein the supplying amount of the metal atoms is controlled by changing the specific surface area of the metal evaporating material arranged in the processing chamber to increase and decrease the amount of evaporation of the metal evaporating material under a constant temperature.

9. Method for manufacturing a permanent magnet of claim 1 wherein the processing chamber has a pressure that is kept at a predetermined reduced pressure before said heating of the processing chamber containing the sintered magnet.

10. Method for manufacturing a permanent magnet of claim 9 wherein the processing chamber has a temperature that is kept at a predetermined temperature after reducing the pressure in the process chamber to said predetermined reduced pressure.

11. Method for manufacturing a permanent magnet of claim 1 wherein the surface of the sintered magnet is cleaned using plasma before said heating of the processing chamber containing the sintered magnet.

12. Method for manufacturing a permanent magnet of claim 1 wherein said heating of the sintered magnet is performed at a temperature lower than said predetermined temperature after diffusing the metal atoms into grain boundary phases of the sintered magnet.

13. Method for manufacturing a permanent magnet of claim 1 wherein the sintered magnet has an average diameter of grain of 1 μm~5 μm or 7 μm~20 μm.

14. Method for manufacturing a permanent magnet of claim 1 wherein the sintered magnet does not contain Co.

15. Method for manufacturing a permanent magnet of claim 1, wherein the depositing and diffusing are performed in a single process.

* * * * *